US005996993A

United States Patent [19]

Arikawa et al.

[11] Patent Number: 5,996,993

[45] Date of Patent: Dec. 7, 1999

[54] BILL HANDLING MACHINE

[75] Inventors: Junichi Arikawa, Kawaguchi; Yoshiyuki Katoh, Tokyo; Toru Inage, Kasukabe; Wataru Iida, Matsudo; Hideo Atsumi, Sayama, all of Japan

[73] Assignee: Laurel Bank Machines Co., Ltd., Tokyo, Japan

[21] Appl. No.: 08/798,484

[22] Filed: Feb. 10, 1997

[30] Foreign Application Priority Data

Feb. 29, 1996 [JP] Japan ..... 8-043532

[51] Int. Cl.[6] ..... B65H 7/02

[52] U.S. Cl. ..... 271/258.01; 271/10.03; 271/10.11; 271/258.02; 271/265.01; 271/270

[58] Field of Search ..... 271/10.03, 10.11, 271/258.01, 258.02, 265.01, 270

[56] References Cited

U.S. PATENT DOCUMENTS

| | | | |
|---|---|---|---|
| 4,883,264 | 11/1989 | Lorenz et al. . | |
| 5,423,528 | 6/1995 | Teranishi et al. | 271/258.02 X |
| 5,599,011 | 2/1997 | Schnorr et al. | 271/10.11 |
| 5,711,518 | 1/1998 | Portaro et al. | 271/10.11 X |

FOREIGN PATENT DOCUMENTS

| | | | |
|---|---|---|---|
| 0130081 A2 | 1/1985 | European Pat. Off. . | |
| 0334309 A2 | 9/1989 | European Pat. Off. . | |
| 2319149 A1 | 10/1973 | Germany . | |
| 3837239 A1 | 5/1989 | Germany . | |
| 362130939 | 6/1987 | Japan | 271/258.01 |
| 362275948 | 11/1987 | Japan | 271/258.01 |
| 363225036 | 9/1988 | Japan | 271/258.01 |
| 404055235 | 2/1992 | Japan | 271/10.11 |
| 405024681 | 2/1993 | Japan | 271/10.11 |
| 405032356 | 2/1993 | Japan | 271/10.11 |
| 406263279 | 9/1994 | Japan | 271/10.11 |
| 52-42306 | 10/1997 | Japan . | |

*Primary Examiner*—Robert P. Olszewski
*Assistant Examiner*—Steven B. McAllister
*Attorney, Agent, or Firm*—Frishauf, Holtz, Goodman, Langer & Chick, P.C.

[57] ABSTRACT

A bill handling machine includes a take-out roller whose entire circumferential surface is formed with a high friction material and which is adapted to engage with leading edge portions of stacked bills and can take out the bills, a separation roller for cooperating with the take-out roller and preventing two or more bills from being simultaneously taken out, a bill sensor provided downstream of the take-out roller and the separation roller for detecting whether or not any bill is present, transporting rollers provided downstream of the bill sensor and rotated at higher speed than the take-out roller, and a controller for temporarily stopping the take-out roller when detection signals have been continuously input from the bill sensor for a time period longer than a predetermined time period. According to the thus constituted bill handling machine, it is possible to reliably and efficiently separate and handle bills whose lengths in the bill transporting direction differ greatly.

2 Claims, 18 Drawing Sheets

BILL HANDLING MACHINE

BACKGROUND OF THE INVENTION

The present invention relates to a bill handling machine such as a bill receiving machine, a bill receiving and dispensing machine or the like, and, in particular, to a bill handling machine which can receive bills whose lengths in the bill transporting direction differ greatly and reliably separate them one by one.

DESCRIPTION OF THE PRIOR ART

It is indispensable in a bill handling machine such as a bill receiving machine to separate received bills one by one to handle them.

Therefore, a bill handling machine is provided with a bill take-out device for once stacking received bills, separate them one by one and remove them using a take-out roller. In this case, the circumferential surface of the take-out roller is ordinarily formed with a high friction material over a length substantially equal to the length of bills whose length is maximum among bills to be handled, and the remaining circumferential surface thereof ordinarily has a length substantially equal to the distance by which bills are successively taken out and is formed with a low friction material.

Bills, such as Japanese bills, whose sizes do not differ so greatly can be separated one by one in this manner either in the case of transporting them so that the shorter edges thereof are aligned with the bill transport direction or in the case of transporting them so that the longer edges thereof are aligned with the bill transport direction.

To the contrary, in the case where bills whose sizes differ greatly, such as bills in European countries which range in size from 181 mm×85 mm to 120 mm×61.5 mm, are transported so that the shorter edges thereof are aligned with the bill transport direction, since the widths thereof in the direction perpendicular to the bill transport direction range from 120 mm to 181 mm, it is difficult to transport bills of smaller size along a desired path for discriminating them. Therefore, bill handling machines which transport bills so that the longer edges thereof are aligned with the bill transport direction are generally used in European countries.

In the case where bills are transported so that the longer edges thereof are aligned with the bill transport direction, the entire circumferential surface of the take-out roller has to be formed with a high friction material. However, if the entire circumferential surface of the take-out roller is formed with a high friction material, two or more bills may be simultaneously taken out or two or more bills may taken out as partly overlapped and, therefore, it is necessary to provide a mechanism for detecting whether or not two or more bills have been simultaneously taken out and separating bills one by one when two or more bills have been simultaneously taken out.

Japanese Patent Publication No. 52-42306 discloses a sheet feeding apparatus provided with such a mechanism. In this sheet feeding apparatus, a sheet or sheets are fed into a gap formed between a feed roller and a return roller and when a double feed detecting means provided immediately downstream of the feed roller and the return roller detects that two or more sheets have been simultaneously taken out, the feed roller is stopped. Then, the sheet or sheets touching the return roller are returned by the return roller, whereby sheets are separate and fed out one by one.

However, application of this sheet feeding apparatus to a bill handling machine lowers the efficiency of the bill handling machine when two or more bills have been simultaneously taken out and the feed roller is stopped, a bill which will not be returned is also stopped, so that the distance between the preceding bill and itself increases to decrease the number of bills that can be handled in a given time.

SUMMARY OF THE INVENTION

It is therefore an object of the present invention to provide a bill handling machine which can reliably and efficiently separate and handle bills whose lengths in the bill transporting direction differ greatly.

The above and other objects of the present invention can be accomplished by a bill handling machine comprising take-out roller means whose entire circumferential surface is formed with a high friction material and which is adapted to engage with leading edge portions of stacked bills and can take out the bills, separation roller means for cooperating with the take-out roller means and preventing two or more bills from being simultaneously taken out, bill detecting means provided downstream of the take-out roller means and the separation roller means for detecting whether or not any bill is present, transporting roller means provided downstream of the bill detecting means and rotated at higher speed than the take-out roller means, and control means for temporarily stopping the take-out roller means when detection signals have been continuously input from the bill detecting means for a time period longer than a predetermined time period.

In a preferred aspect of the present invention, the predetermined time period is determined to be equal to a time period required to detect bills whose length is maximum among bills to be handled.

The above and other objects and features of the present invention will become apparent from the following description made with reference to the accompanying drawings.

DESCRIPTION OF THE PREFERRED EMBODIMENT

Figure 1:
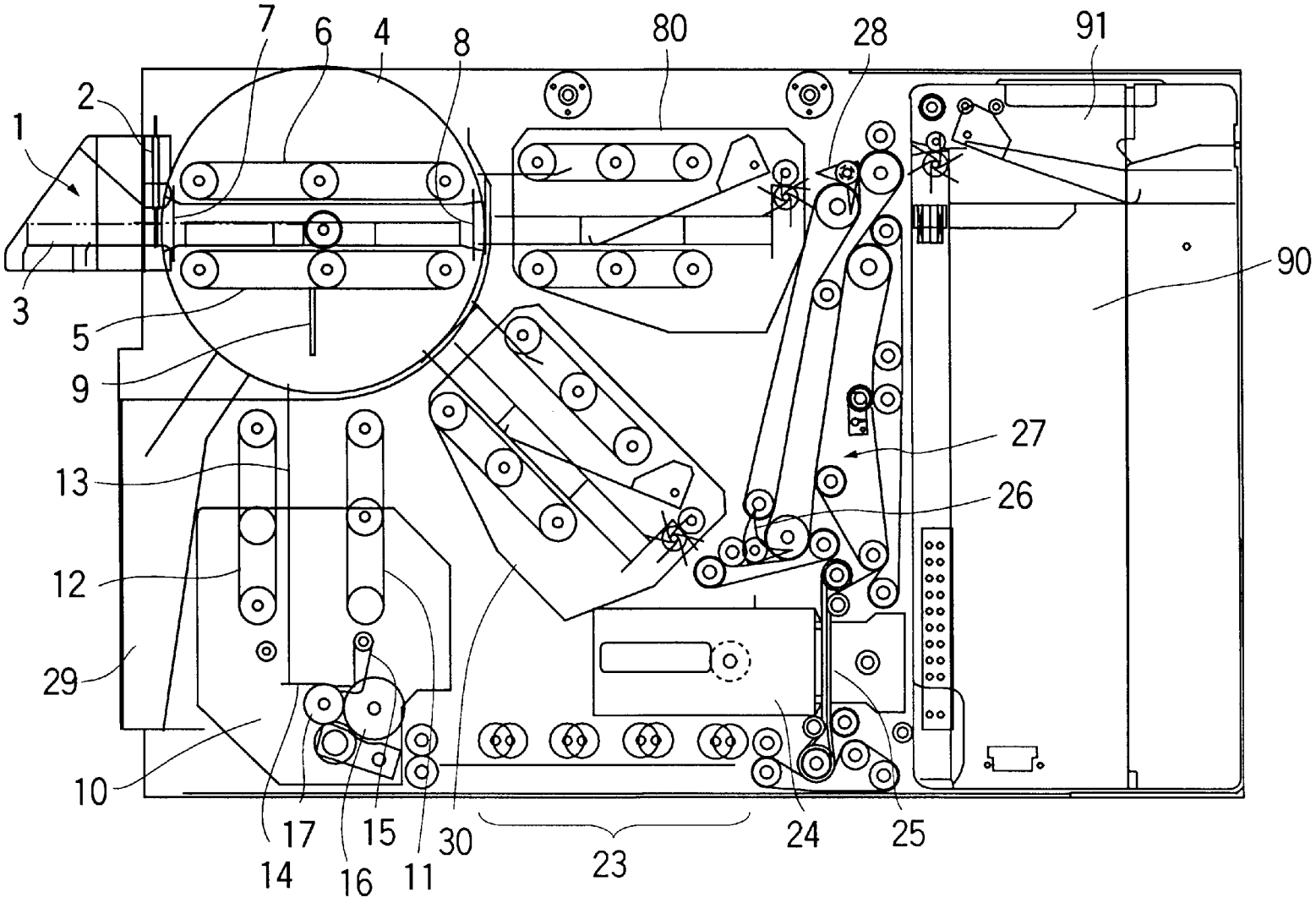
FIG. 1 is a schematic longitudinal cross sectional view of a bill receiving machine which is an embodiment of the present invention.

As shown in FIG. 1, a bill receiving machine includes a transaction opening 1 used for receiving bills and returning unacceptable bills and the transaction opening 1 is connected to the inside of the bill receiving machine via a shutter 2. A bill placement base 3 is provided in the transaction opening 1 and bills are placed on the bill placement base 3 to be received by the bill receiving machine and unacceptable bills are placed on the bill placement base 3 to be returned.

A hollow rotatable drum 4 is provided at a position adjacent to the shutter 2 in the bill receiving machine. In the drum 4, a pair of endless drive belts 5 and a pair of endless driven belts 6 are provided so as to face each other and the pair of endless driven belts 6 are movable with respect to the pair of endless drive belts 5. A first shutter 7 and a second shutter 8 are provided at opposite end portions of a bill transport passage formed by the endless drive belts 5 and the endless driven belts 6 for opening and closing the bill transport passage and a third shutter 9 is provided at a substantially central portion of the bill transport passage formed by the endless drive belts 5 and the endless driven belts 6 so as to be able to project into and be retracted from the bill transport passage. The length of the bill transport passage formed by the endless drive belts 5 and the endless driven belts 6 is determined to be slightly greater than the length of the longer edge of the bill whose longer edge is greatest among bills to be handled and the length between the end portion of the bill placement base 3 in the transaction opening 1 on the side opposite from the drum 4 and the central portion into which the third shutter 9 projects is also determined to be slightly greater than the length of the longer edge of the bill whose longer edge is greatest among bills to be handled. Further, the length between the end portion of the bill placement base 3 in the transaction opening 1 on the side opposite from the drum 4 and the end portion of the bill transport passage formed by the endless drive belts 5 and the endless driven belts 6 on the side of the transaction opening 1 and the length between the end portion of the bill placement base 3 on the side of the drum 4 and the third shutter 9 are determined to be shorter than the length of the longer edge of bill whose longer edge is shortest among bills to be handled. Bills are deposited into the transaction opening 1, while the shutter 2 and the first shutter 7 of the drum 4 facing the transaction opening 1 are opened and the third shutter 9 is kept projecting into the bill transport passage. Therefore, bills whose longer edges are greatest among bills to be handled are accommodated between the end portion of the bill placement base 3 on the side opposite from the drum 4 and the third shutter 9 to substantially abut against the third shutter 9 and that bills whose longer edges are shortest are accommodated between the end portion of the bill placement base 3 on the side opposite from the drum 4 and the third shutter 9 in such a manner that parts thereof are placed on the endless drive belts 5. As a result, after the third shutter 9 has been retracted from the bill transport passage and the endless driven belts 6 are lowered, bills deposited into the transaction opening 1 can be held between the endless drive belts 5 and the endless driven belts 6 and reliably taken into the drum 4 by driving the endless drive belts 5. The drum 4 is rotatable by a motor (not shown) mounted on the body of the bill receiving machine.

A bill receiving section 10 is provided immediately below the drum 4. The bill receiving section 10 comprises a pair of fixed endless drive belts 11, a pair of endless driven belts 12 movable between a holding position where bills are held between the endless drive belts 11 and themselves and a retracted position where bills are released, a bill press plate 13 supported integrally with the endless driven belts 12 and movable in parallel to the surface of the endless driven belts 12 on the side of the endless drive belts 11, a lower end plate 14 forming the lower portion of the bill receiving section 10, a shutter 15 capable of opening and closing a portion between the endless drive belts 11 and the lower end plate 14, a take-out roller 16 provided in the vicinity of the lower end plate 14 and the lower portion of the shutter 15 for taking out bills from the bill receiving section 10, and a separation roller 17 for ensuring that bills are taken out one by one by the take-out roller 16. The endless drive belts 11 are disposed so that the surfaces thereof on the side of the endless driven belts 12 are flush with the surfaces of the corresponding endless drive belts 5 when the drum 4 is rotated counterclockwise from the position shown in FIG. 1 by 90 degrees.

When bills taken into the drum 4 and held between the endless drive belts 5 and the endless driven belts 6 are to be fed to the bill receiving section 10, the drum 4 is rotated counterclockwise from the position shown in FIG. 1 by 90 degrees and the endless drive belts 5 and the endless drive belts 11 are driven. As a result, the bills are fed into the space between the endless drive belts 11 and the endless driven belts 12 and held therebetween. Further, the bills are fed into the bill receiving section 10 by driving the endless drive belts 11. Then, the endless driven belts 12 are retracted to the retracted position and the bills are stored in the bill receiving section 10 as supported by the endless drive belts 11, the bill press plate 13 and the lower end plate 14.

A first bill transporting section 23 is connected to the downstream side of the take-out roller 16 of the bill receiving section 10. Bills received in the bill receiving section 10 are taken out one by one by the take-out roller 16 and the separation roller 17 and after the number of bills has been counted by a sensor (not shown) provided immediately downstream of the take-out roller 16, they are fed to the first bill transporting section 23.

The first bill transporting section 23 is constituted so as to transport a bill toward the rear side of the bill receiving machine, while simultaneously correcting the orientation of the bill if its longer edge form an angle with the bill transporting direction so that the longer edge of the bill is aligned with the bill transporting direction.

A second bill transporting section 25 extending upwardly is provided at the terminal end portion of the first bill transporting section 23. A bill is delivered from the first bill transporting section 23 to the second bill transporting section 25 and transported upwardly and then toward the front side of the bill receiving machine.

A bill discriminating section 24 is provided at the beginning end portion of the second bill transporting section 25 for discriminating whether or not bills are acceptable and the denomination of the bills which are acceptable. A first gate member 26 is provided at the terminal end portion of the second bill transporting section 25. A bill discriminated to be unacceptable by the bill discriminating section 24 is fed to a first bill stacking device 30 by the first gate member 26. On the other hand, a bill discriminated to be acceptable is delivered to a third bill transporting section 27 connected to the terminal end portion of the second bill transporting section 25 and is transported upwardly. It is then stacked in a second bill stacking device 80 by a second gate member 28.

The first bill stacking device 30 is disposed behind and below the drum 4 in such a manner that its longitudinal direction forms an angle of 45 degrees with the horizon and the second bill stacking device 80 is disposed behind the drum 4 in such a manner that its longitudinal direction is substantially horizontal. The first bill stacking device 30 and the second bill stacking device 80 have the same structure. The first bill stacking device 30 communicates with the drum 4 so as to be able to deliver bills to the drum 4 when the drum 4 is rotated clockwise from the position shown in FIG. 1 by about 45 degrees and the second bill stacking device 80 communicates with the drum 4 so as to be able to deliver bills to the drum 4 when the drum 4 is located at the position shown in FIG. 1.

The bill receiving machine further comprises an unacceptable bill collecting section 29 located on the front side of the bill receiving section 10 for collecting any bill discriminated to be unacceptable by the bill discriminating section 24 and not accepted by the customer although once returned to the customer, and a safe 90 located on the rear side of the bill receiving machine for storing received and acceptable bills.

When all received bills have been fed out from the bill receiving section 10, unacceptable bills stacked in the first bill stacking section 30 are fed to the drum 4 and returned to the transaction opening 1. Unacceptable bills returned to the transaction opening 1, but not accepted by the customer, are again fed to the drum 4 and collected in the unacceptable bill collecting section 29.

The total value of the deposited bills is displayed on a display means (not shown) based on the discrimination made by the bill discriminating section 24. When the customer confirms the amount of deposited bills and instructs the machine to receive the bills, the acceptable bills stacked in the second bill stacking device 80 are fed to the drum 4 and further fed to the third bill transporting section 27 via the bill receiving section 10, the first bill transporting section 23, the bill discriminating section 24 and the second bill transporting section 25. Then, they are stored in the safe 90 by the second gate member 28.

Figure 2:
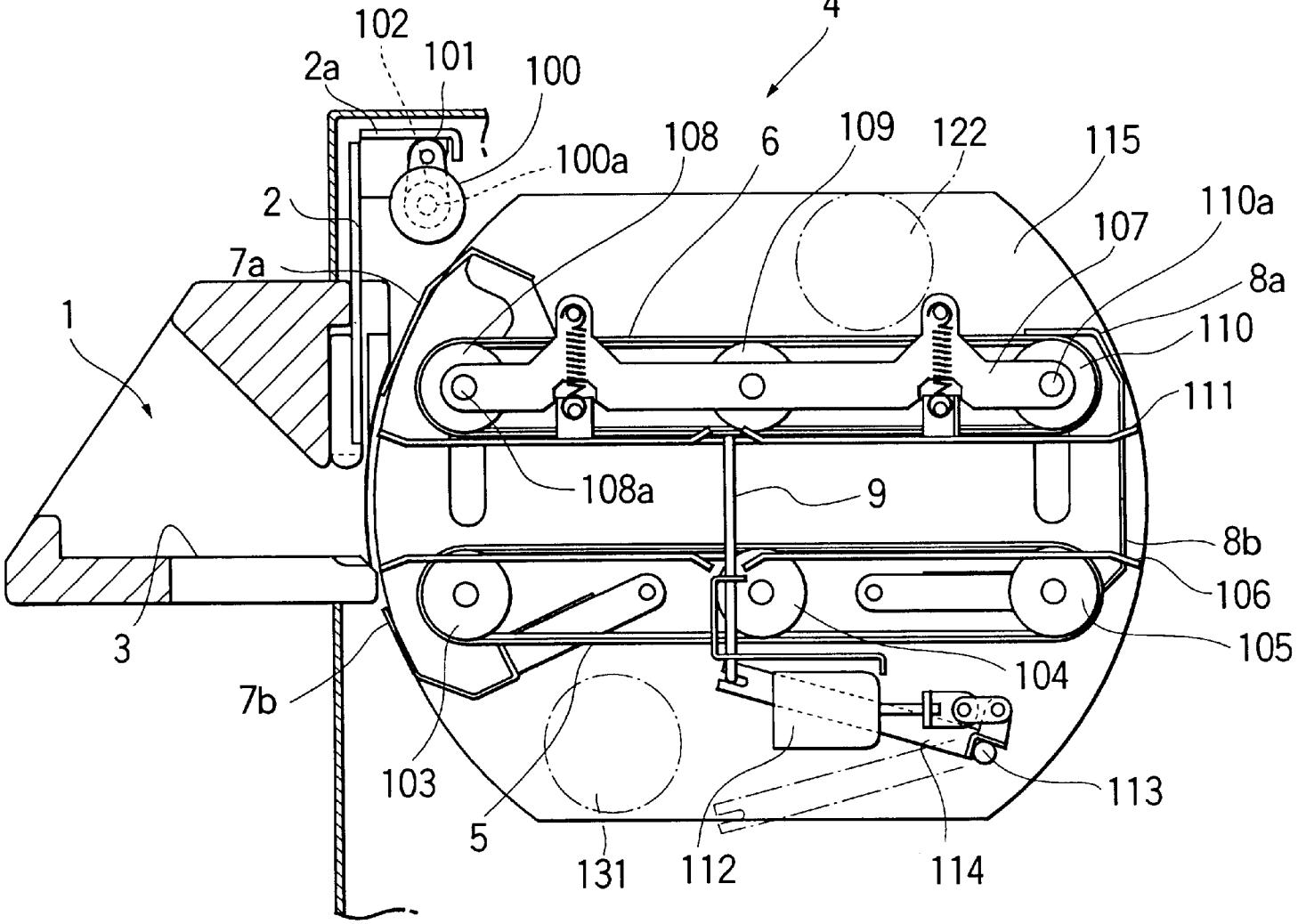
FIG. 2 is a schematic longitudinal cross sectional view showing the details of a transaction opening and a drum shown in FIG. 1.

FIG. 2 is a schematic longitudinal cross sectional view showing the details of the transaction opening and the drum shown in FIG. 1.

As shown in FIG. 2, a motor 100 is provided above the shutter 2 and the drum 4 for opening and closing the shutter 2. An arm 102 is fixed to the output shaft 100*a* of the motor 100 and a roller 101 is rotatably mounted on the tip end portion of the arm 102. The roller 101 abuts against the lower surface of a bent portion 2*a* of the shutter 2 extending from the upper portion of the shutter 2 toward the drum 4 in substantially the horizontal direction and supports it. Therefore, when the motor 100 is driven and the arm 102 is swung counterclockwise in FIG. 2, the roller 101 mounted on the tip end portion of the arm 102 is lowered along an arcuate path and, therefore, the bent portion 2*a* of the shutter 2 is lowered, whereby the shutter 2 is moved from the open position shown in FIG. 2 to a closed position where it shuts off the communication between the transaction opening 1 and the inside of the bill receiving machine.

Figure 3:
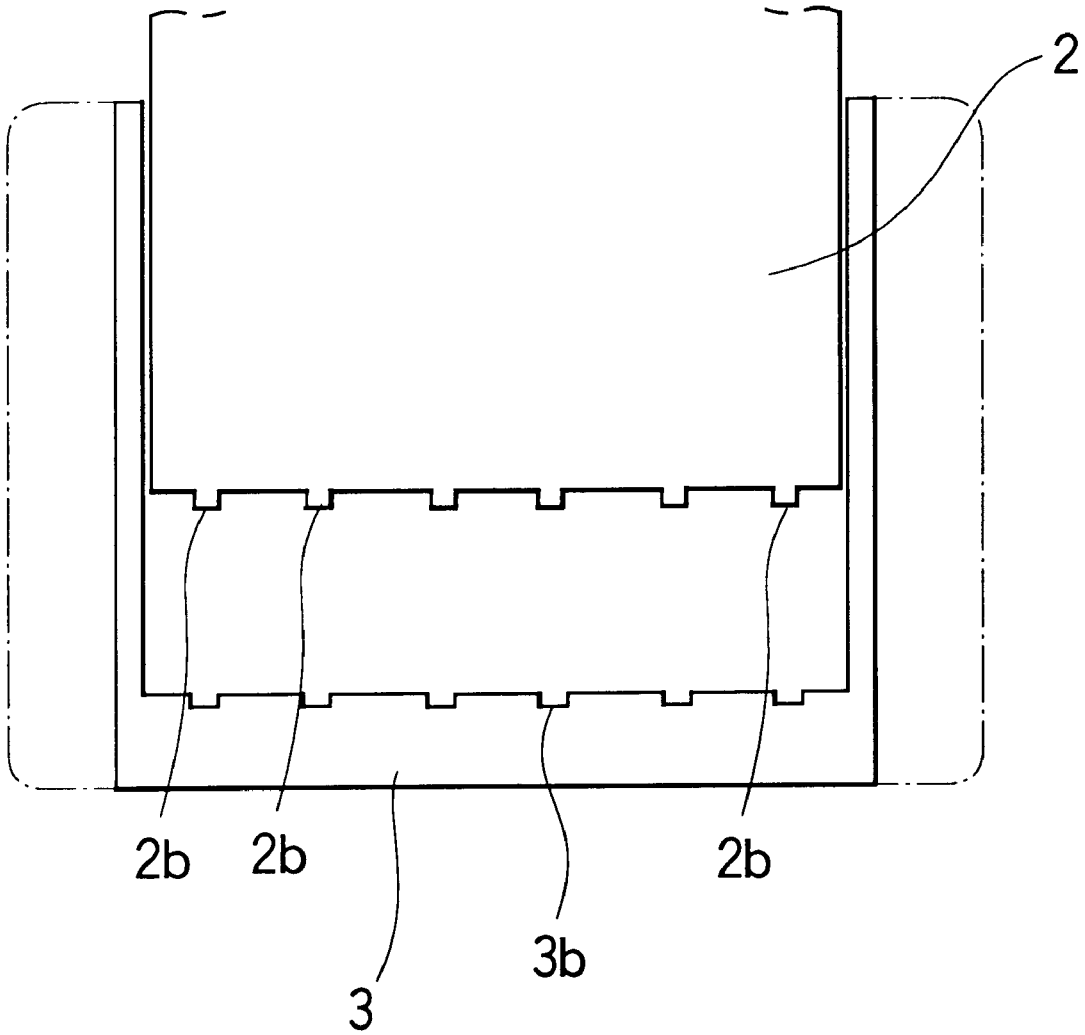
FIG. 3 is a schematic front view of a shutter.

FIG. 3 is a schematic front view of the shutter 2.

As shown in FIG. 3, the lower edge of the shutter 2 is formed with a plurality of projections 2*b* projecting downwardly at substantially regular intervals. The end portion of the bill placement base 3 on the side of the drum 4 is formed with concave portions 3*b* whose size and shape are complementary to the projections 2*b* of the shutter 2. The projections 2*b* can therefore engage with the concave portions 3*b* unless one or more bills remain between the shutter 2 and the bill placement base 3, in which case the projections 2*b* and the concave portions 3*b* do not completely engage with each other and the shutter 2 cannot be closed. As a consequence, it is possible to detect whether or not bills remain between the shutter 2 and the bill placement base 3 by detecting whether or not the shutter 2 is closed.

As shown in FIG. 2, the endless drive belts 5 fixed to the drum 4 are wound around rollers 103, 104, 105 and a bill guide 106 is mounted on the drum 4 slightly below the surface of the endless drive belts 5 on the side of the endless driven belts 6.

Further, the movable endless driven belts 6 are wound around rollers 108, 109, 110 and the rollers 108, 109, 110 are rotatably mounted on a connecting member 107 mounted on the drum 4 to be movable in the direction perpendicular to the bill transporting direction. A bill guide 111 is mounted on the side of the endless drive belts 5 to be movable in the direction perpendicular to the surface of the endless driven belts 6. When the endless driven belts 6 are moved apart from the endless drive belts 5, the bill guide 111 engages with a stopper (not shown) and is located at a position closer to the endless drive belts 5 than the surface of the endless driven belts 6 on the side of the endless drive belts 5. On the other hand, when the endless driven belts 6 are moved close to the endless drive belts 5 so as to be able to hold bills between the endless drive belts 5 and themselves, the bill guide 111 is retracted to a position more apart from the endless drive belts 5 than the surfaces of the endless driven belts 6 on the side of the endless drive belts 5, thereby preventing the bill guide 111 from influencing the bill holding and the bill transportation.

As shown in FIG. 2, the first shutter 7 provided at one end portion of the bill transport passage formed by the endless drive belts 5 and the endless driven belts 6 comprises an upper shutter member 7*a* and a lower shutter member 7*b* and the second shutter 8 provided the other end portion of the bill transport passage comprises an upper shutter member 8*a* and a lower shutter member 8*b*. The first shutter 7 and the second shutter 8 are closed or opened by moving the upper shutter members 7*a*, 8*a* and the lower shutter members 7*b*, 8*b* so as to be close to or apart from each other.

Further, the lower end portion of the third shutter 9 which can project into or be retracted from the bill transport passage formed by the endless drive belts 5 and the endless driven belts 6 at substantially the central portion thereof is connected to the tip end portion of a swing arm 114 swingable about a shaft 113 by a solenoid 112 in FIG. 2. The third shutter 9 can be projected into the bill transport passage between the pair of endless drive belts 5 by actuating the solenoid 112 and swinging the swing arm 114 about the shaft 113 from a retracted position indicated by a broken line in FIG. 2 to a projected position indicated by a solid line in FIG. 2.

Figure 4:
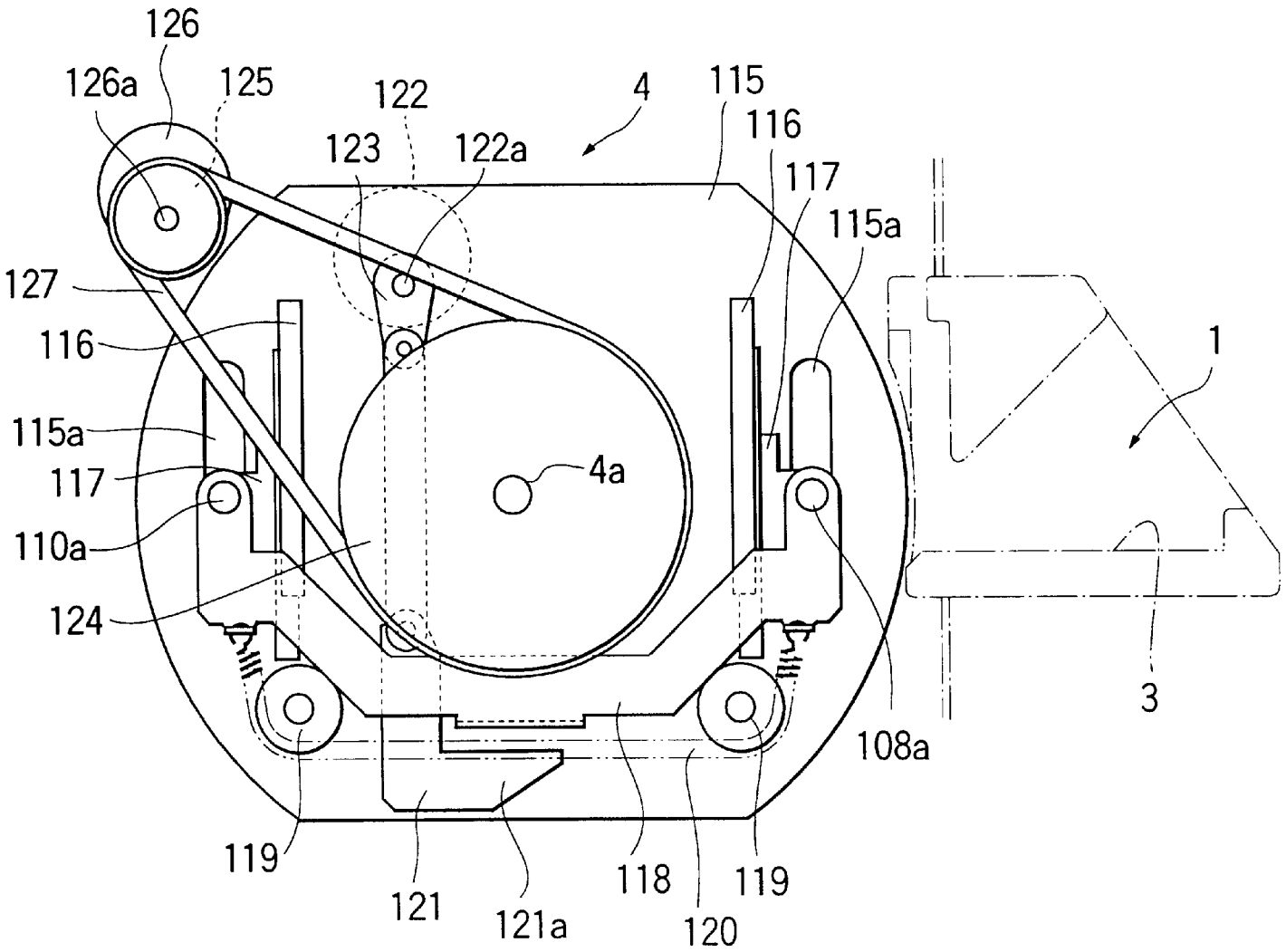
FIG. 4 is a schematic left side view of a drum of a bill receiving machine.

FIG. 4 is a schematic left side view of the drum 4 of the bill receiving machine.

As shown in FIG. 4, roller shafts 108*a*, 110*a* of the rollers 108, 110 among the three rollers 108, 109, 110 around which the endless driven belts 6 are wound project the outside of the drum 4 through a pair of elongate slots 115*a*, 115*a* formed on the left side plate 115 of the drum 4 with respect to the bill transporting direction to extend in the direction perpendicular to the bill transport passage and are connected to a pair of blocks 117, 117 movable along a pair of slide rails 116, 116 in the direction perpendicular to the bill transport passage. The pair of blocks 117, 117 are connected to the opposite end portions of a connecting plate 118. In FIG. 4, the opposite end portions of a spring 120 provided along the lower sides of a pair of pulleys 119, 119 are connected to the lower edge portions at the opposite end portions of the connecting plate 118, whereby the connecting plate 118 is biased downwardly.

As shown in FIG. 4, a substantially L-shaped release arm 121 is mounted on the drum 4 to be movable in the direction perpendicular to the bill transport passage. When the release arm 121 is moved upwardly in FIG. 4, the upper side surface of a bent portion 121 a extending from the lower end portion of the release arm 121 in substantially the horizontal direction engages with the lower edge portion at the center portion of the connecting plate 118, whereby the connecting plate 118 is moved upwardly against the spring force ot the spring 120. The upper end portion of the release arm 121 in FIG. 4 is connected to a swing arm 123 fixed to the output shaft 122*a* of a motor 122 mounted on the side plate 115 of the drum 4 and is movable upwardly in FIG. 4 by rotating the motor 122.

Further, as shown in FIG. 4, a pulley 124 is fixed to the side plate 115 of the drum 4 and a belt 127 is wound around the pulley 124 and a pulley 125 fixed to the output shaft 126*a* of a motor 126 mounted on the body of the bill receiving machine. The drum 4 is rotatable about a center shaft 4*a* thereof by driving the motor 126. In this embodiment, the motor 126 can be repeatedly rotated little by little in both forward and reverse directions by a later mentioned CPU (not shown).

Figure 5:
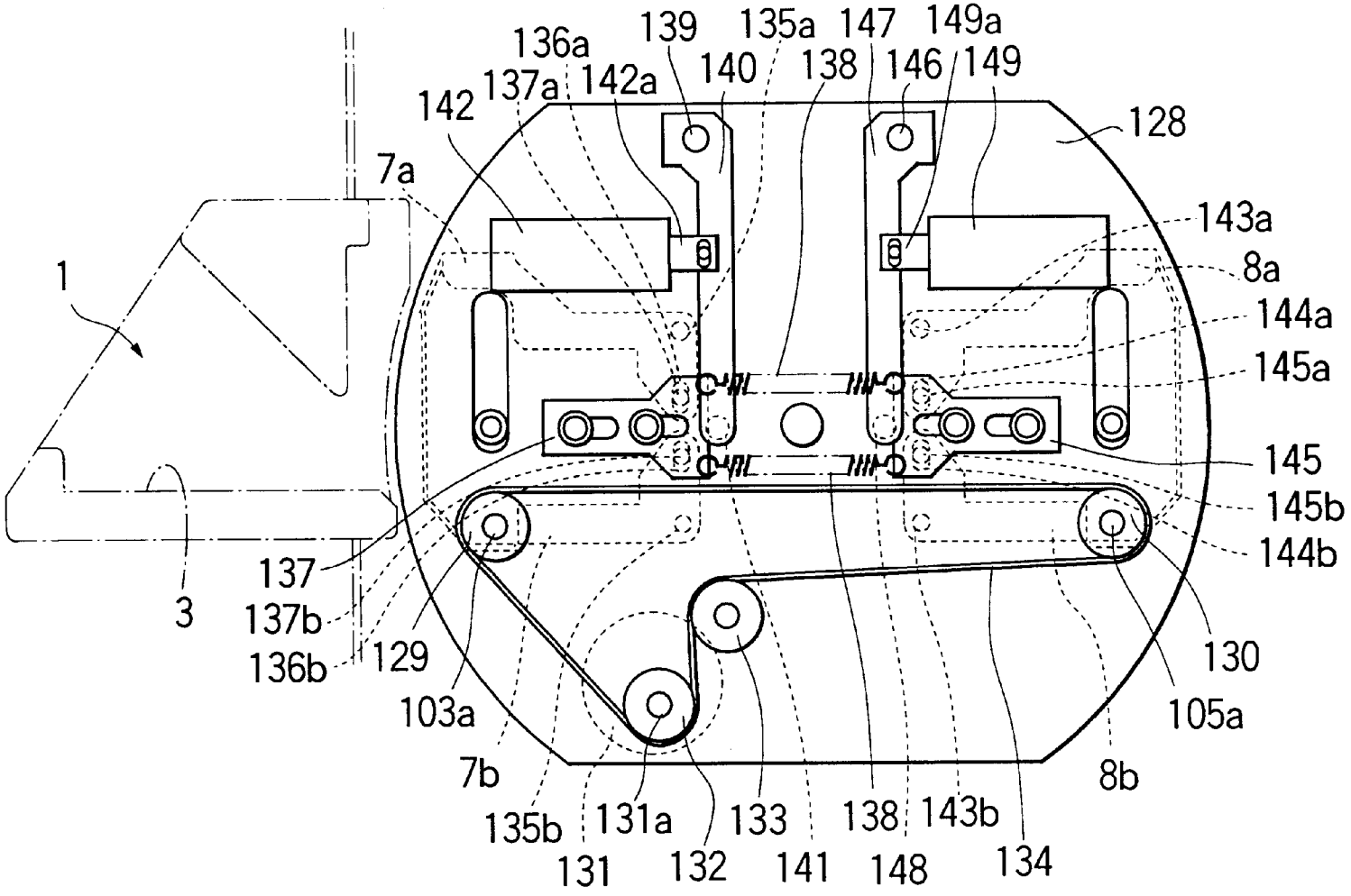
FIG. 5 is a schematic right side view of a drum of a bill receiving machine.

FIG. 5 is a schematic right side view of the drum 4 of the bill receiving machine.

As shown in FIG. 5, roller shafts 103*a*, 105*a* of the rollers 103, 105 among the three rollers 103, 104, 105 around which the endless drive belts 5 are wound project the outside of the drum 4 through the right side plate 128 of the drum 4 and pulleys 129, 130 are mounted on the projecting roller shafts 103*a*, 105*a*. A driven pulley 132 mounted on the output shaft 131*a* of a motor 131 for driving the endless drive belts 5 and a driven pulley 133 are mounted on the side plate 128. A belt 134 is wound around the pulleys 129, 130, 132, 133 and driving force of the motor 131 is transmitted to the endless drive belts 5 via the pulleys 129, 130 and rollers 103, 105.

Further, as shown in FIG. 5, the upper shutter member 7*a* and the lower shutter member 7*b* constituting the first shutter 7 are mounted on the drum 4 so as to be swingable about pins 135*a*, 135*b* extending in the direction perpendicular to the bill transporting direction between a closed position where they close the bill transport passage and a open position where they open the bill transport passage. In FIG. 5, the portion of the upper shutter member 7*a* below the pin 135*a* is formed with an elongate slot 136*a* extending in the direction perpendicular to the bill transportation direction and the lower shutter member 7*b* above the pin 135*b* is formed with an elongate slot 136*b* extending in the direction perpendicular to the bill transportation direction. Pins 137*a*, 137*b* formed on a slide plate 137 movably mounted on the drum 4 in the bill transporting direction penetrate through the elongate slots 136*a*, 136*b*. One end portions of a pair of springs 138, 138 are connected to the end portion of the slide plate 137 closer to the second shutter 8. The slide plate 137 is biased by the pair of springs 138, 138 toward the second shutter 8 to hold the upper shutter member 7*a* and the lower shutter member 7*b* via the pins 137*a*, 137*b* at the closed position as shown in FIG. 5.

Furthermore, a pin 141 provided at the tip end portion of a drive arm 140 mounted on the drum 4 to be swingable about a shaft 139 engages with the end portion of the slide plate 137 closer to the second shutter 8. The tip end portion of the plunger 142*a* of a solenoid 142 is connected to the drive arm 140 between the shaft 139 and the pin 141. Therefore, when the solenoid 142 is actuated and the plunger 142*a* is retracted, the drive arm 140 is swung clockwise in FIG. 5 about the shaft 139 and the slide plate 137 is moved toward the first shutter 7 against the spring force of the springs 138, 138. As a result, the upper shutter member 7*a* and the lower shutter member 7*b* are swung about the pins 135*a*, 135*b* via the pins 137*a*, 137*b* and are moved from the closed position indicated by a broken line in FIG. 5 to the open position.

As shown in FIG. 5, the upper shutter member 8*a* and the lower shutter member 8*b* constituting the second shutter 8 are mounted on the drum 4 so as to be swingable about pins 143*a*, 143*b* extending in the direction perpendicular to the bill transportation direction between a closed position where they close the bill transport passage and a open position where they open the bill transport passage. In FIG. 5, the portion of the upper shutter member 8*a* below the pin 143*a* is formed with an elongate slot 144*a* extending in the direction perpendicular to the bill transportation direction and the portion of the lower shutter member 8*b* above the pin 143*b* is formed with an elongate slot 144*b* extending in the direction perpendicular to the bill transportation direction. Pins 145*a*, 145*b* formed on a slide plate 145 movably mounted in the bill transporting direction on the drum 4 penetrate through the elongate slots 144*a*, 144*b*. The other end portions of the pair of springs 138, 138 one end portions of which are connected on the slide plate 137 are connected to the end portion of the slide plate 145 closer to the first shutter 7. The slide plate 145 is biased by the pair of springs 138, 138 toward the first shutter 7 to hold the upper shutter member 8*a* and the lower shutter member 8*b* via the pins 144*a*, 144*b* at a closed position as shown in FIG. 5.

Further, a pin 148 provided at the tip end portion of a drive arm 147 mounted on the drum 4 to be swingable about a shaft 146 engages with the end portion of the slide plate 145 closer to the first shutter 7. The tip end portion of a plunger 149*a* of a solenoid 149 is connected to the drive arm 147 between the shaft 146 and the pin 148. Therefore, when the solenoid 149 is actuated and the plunger 149*a* is retracted, the drive arm 147 is swung counterclockwise in FIG. 5 about the shaft 146 and the slide plate 145 is moved toward the second shutter 8 against the spring force of the springs 138, 138. As a result, the upper shutter member 8*a* and the lower shutter member 8*b* are swung about the pins 143*a*, 143*b* via the pins 145*a*, 145*b* and are moved from the closed position indicated by a broken line in FIG. 5 to the open position.

Figure 6:
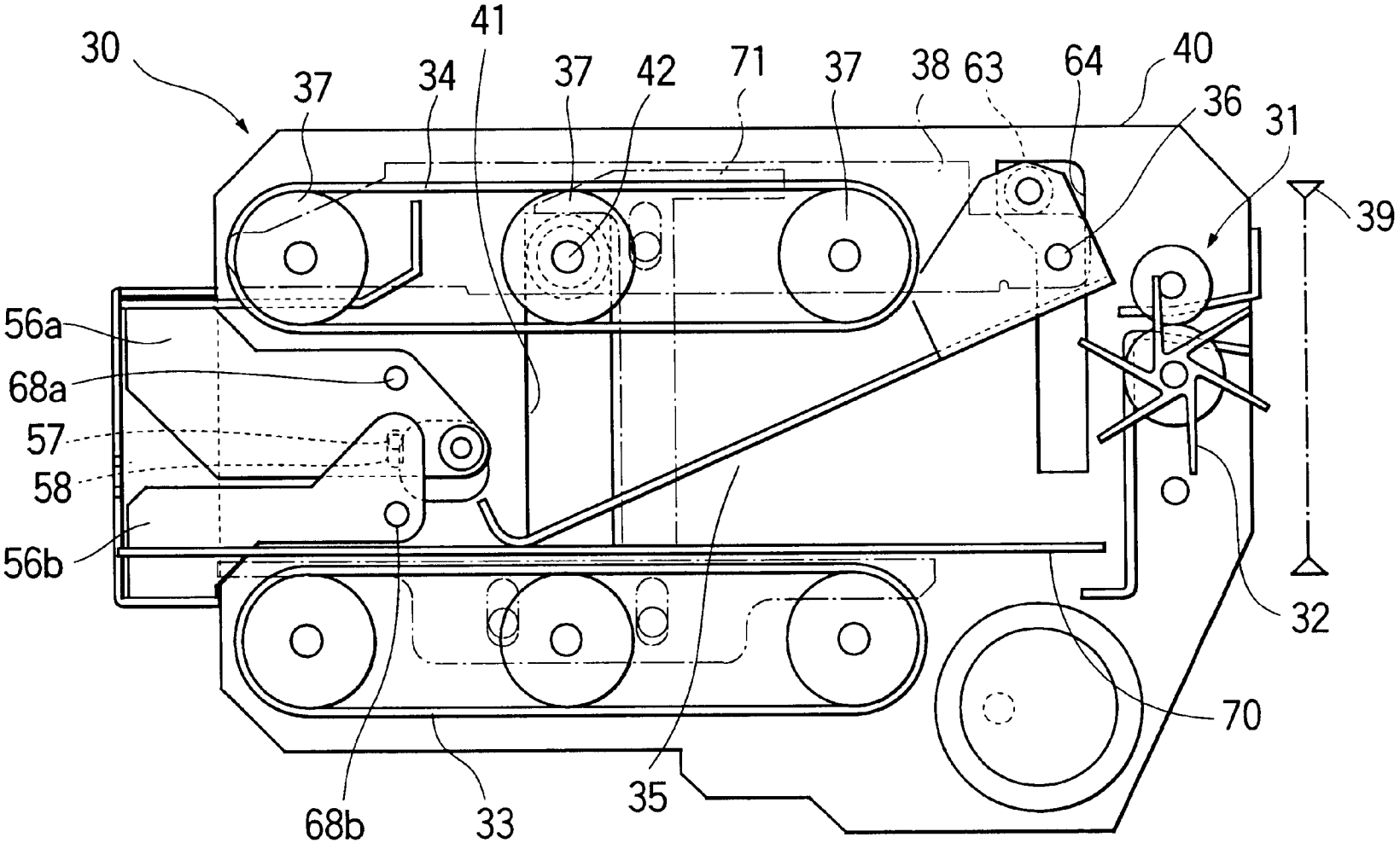
FIG. 6 is a schematic side view showing the structure of a first bill stacking device.

FIG. 6 is a schematic side view showing the structure of the first bill stacking device 30.

As shown in FIG. 6, the first bill stacking device 30 comprises a vane wheel 32 below a roller pair 31 located adjacent to the first gate member 26 shown in FIG. 1, a pair of fixed endless drive belts 33 below the vane wheel 32 and a pair of movable endless driven belts 34 above the vane wheel 32. A bill press plate 35 for pressing stacked bills is swingably mounted on a support shaft 36. A group of rollers 37 and the support shaft 36 are supported by a mounting unit 38. A sensor 39 for detecting the rear end portion of a bill is provided on the side of the vane wheel 32 nearer the first gate member 26. The center portion of a unit side plate 40 to which the endless drive belts 33 are fixed is formed with an opening 41 extending perpendicularly to the endless drive belts 33, and a roller shaft 42 fixed to the mounting unit 38 for rotatably supporting a central roller around which the endless driven belts 34 are wound projects to the outside of the unit side plate 40 through the opening 41.

Figure 7:
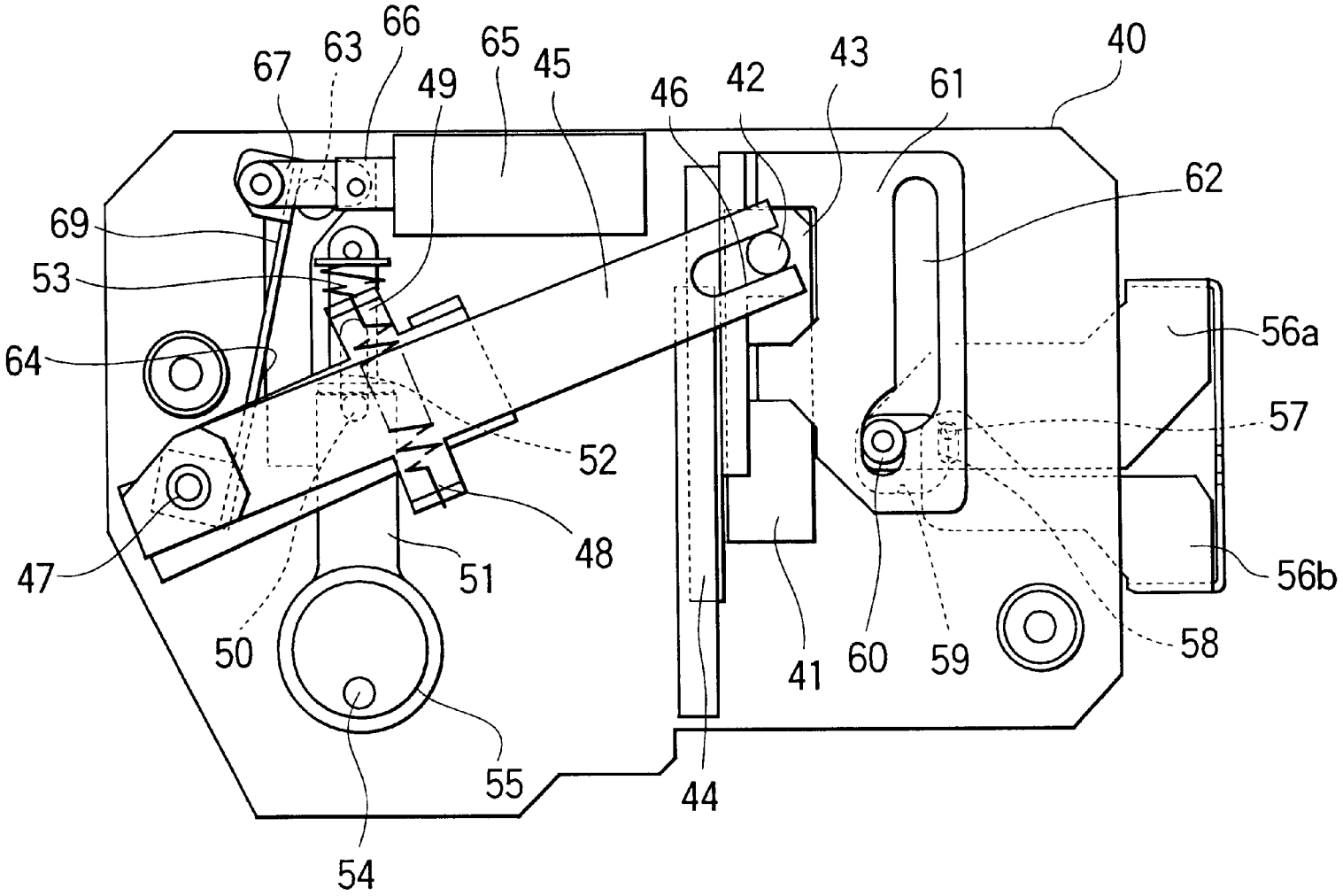
FIG. 7 is a schematic rear view of FIG. 6.

FIG. 7 is a schematic rear view of FIG. 6.

As shown in FIG. 7, the roller shaft 42 for rotatably supporting the central roller around which the endless driven belts 34 are wound among the group of rollers 37 is fixed to a block 43 and the block 43 is supported by a slide rail 44 extending perpendicularly to the endless drive belts 33 formed on the unit side plate 40. The roller shaft 42 is rotatably engaged with a notched portion 46 formed in the tip end portion of a swing arm 45 and the swing arm 45 is swingably supported by a shaft 47. One end portion of a spring 48 is connected to the swing arm 45 and the other end portion of the spring 48 is connected to a connecting arm 49. The connecting arm 49 is swingably supported by the shaft 47 and is formed with a pin 50. The pin 50 is fitted into an elongate slot 52 formed in a crank arm 51 and biased by a spring 53 downwardly in FIG. 7. A cam 55 to which a motor shaft 54 is fixed is rotatably mounted on the crank arm 51.

As shown in FIGS. 6 and 7, the first bill stacking device 30 comprises an upper shutter member 56*a* swingable upwardly about a pin 68*a* and a lower shutter member 56*b* swingable downwardly about a pin 68*b* on the side opposite from the vane wheel 32. The upper shutter member 56*a* and the lower shutter member 56*b* are connected to each other by a pin 57 provided on the lower shutter member 56*b* and an elongate slot 58 formed in the upper shutter member 56*a*.

The upper shutter member 56*a* is formed with a roller 60 projecting to the outside through an opening 59 formed in the unit side plate 40 and the roller 60 is engaged with a guide slot 62 formed in a guide member 61 supported by the block 43.

In the thus constituted first bill stacking device 30, the endless driven belts 34 can be moved with respect to the endless drive belts 33 by rotating the motor shaft 54.

More specifically, when the motor shaft 54 is rotated while the endless driven belts 34 shown in FIGS. 6 and 7 are apart from the endless drive belts 33, the cam rotates a half turn, whereby the crank arm 51 is lowered. Since the pin 50 formed on the connecting arm 49 and fitted into the elongate slot 52 formed in the crank arm 51 is biased downwardly by the spring 53, it is lowered and the connecting arm 49 is swung downwardly. Therefore, the swing arm 45 is also swung downwardly by the spring 48 and the roller shaft 42 rotatably engaged with the notched portion 46 formed on the tip end portion of the swing arm 45 is lowered, whereby the mounting unit 38 is lowered and the endless driven belts 34 mounted on the mounting unit 38 is moved close to the endless drive belts 33.

When the endless driven belts 34 is lowered and comes into abutment with bills stacked in the first bill stacking device 30, the lowering movement of the mounting unit 38 is stopped and the swinging movements of the swing arm 45 and the connecting arm 49 are also stopped. Although the crank arm 51 continues to be lowered, the movement of the pin 50 formed on the connecting arm 49 and fitted into the elongate slot 52 formed in the crank arm 51 is stopped. As a result, bills stacked in the first bill stacking device 30 are held between the endless driven belts 34 and the endless drive belts 33 by the spring force of the spring 53.

Further, as shown in FIGS. 6 and 7, the bill press plate 35 comprises a roller 63 projecting to the outside through an opening 64 formed in the unit side plate 40 at a position apart from the support shaft 36 for swingably supporting the bill press plate 35. On the other hand, as shown in FIG. 7, on the wall portion of the unit side plate 40 on the opposite side from the endless drive belts 33 and the endless driven belts 34, are provided a solenoid 65, a link 67 connected to a plunger 66 of the solenoid 65 and an actuating plate 69 one end portion of which is swingably supported by the shaft 47 formed on the unit side plate 40, the other end portion of which is connected to the tip end portion of the link 67 and the side surface of which abuts against the roller 63.

As shown in FIGS. 6 and 7, when bills are stacked in the first bill stacking device 30, the endless driven belts 34 are kept at a position apart from the endless drive belts 33 and at this time, the actuating plate 69 abuts against the roller 63. After the bills have been fed into the first bill stacking device 30, the solenoid 65 is driven at appropriate timing and the actuating plate 69 presses the roller 63 to the left in FIG. 6 and to the right in FIG. 7, whereby bills are stacked by the bill press plate 35 in such a manner that the rear edges of the bills are aligned with one of the wall portions of the first bill stacking device 30.

Figure 8:
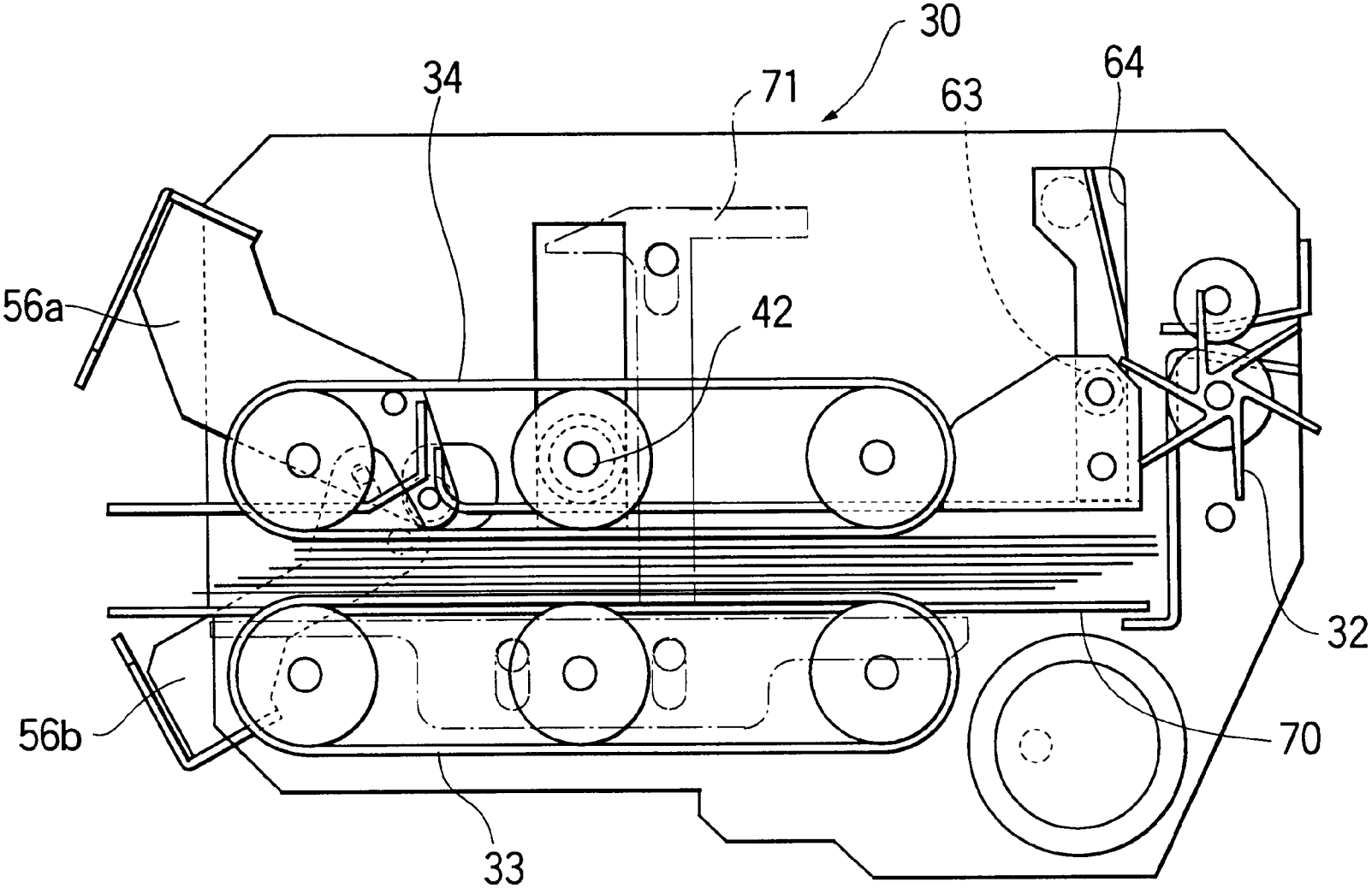
FIG. 8 is a schematic side view showing a first bill stacking device in which stacked bills are held between a pair of endless driven belts and a pair of endless drive belts.
Figure 9:
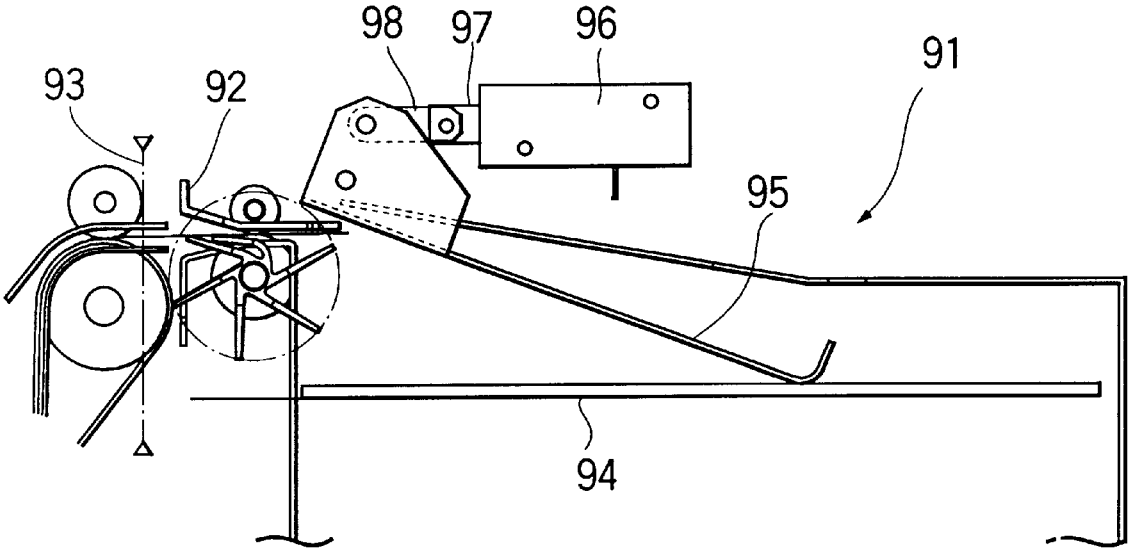
FIG. 9 is a schematic side view showing a bill stacking device of a safe in which the leading end portion of a bill has just been fed into the safe.
Figure 10:
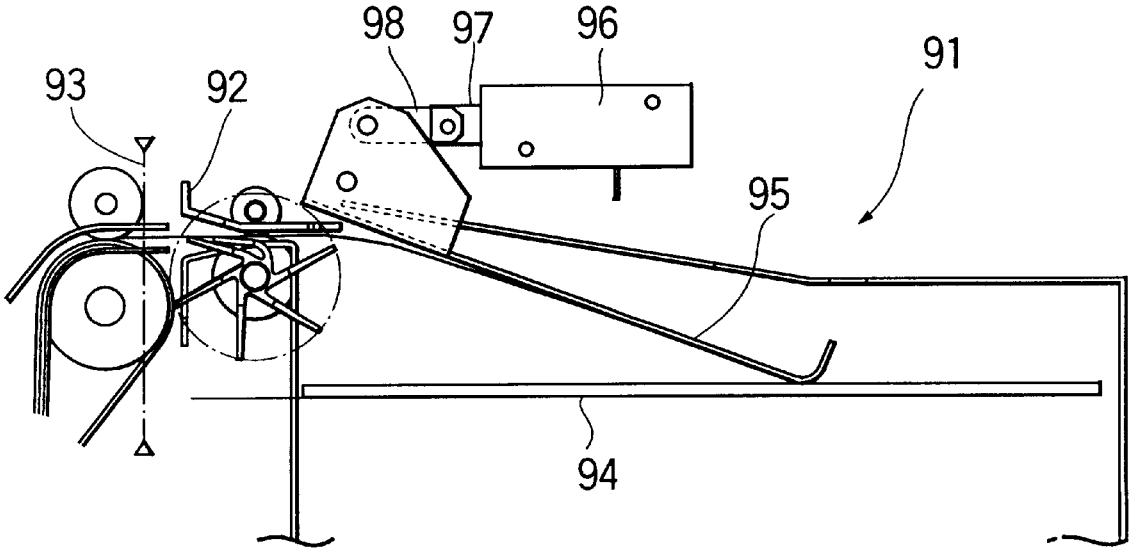
FIG. 10 is a schematic side view showing a bill stacking device of a safe in which the leading end portion of a bill has been fed into the safe and the bill is led along the lower surface of a bill press plate.
Figure 11:
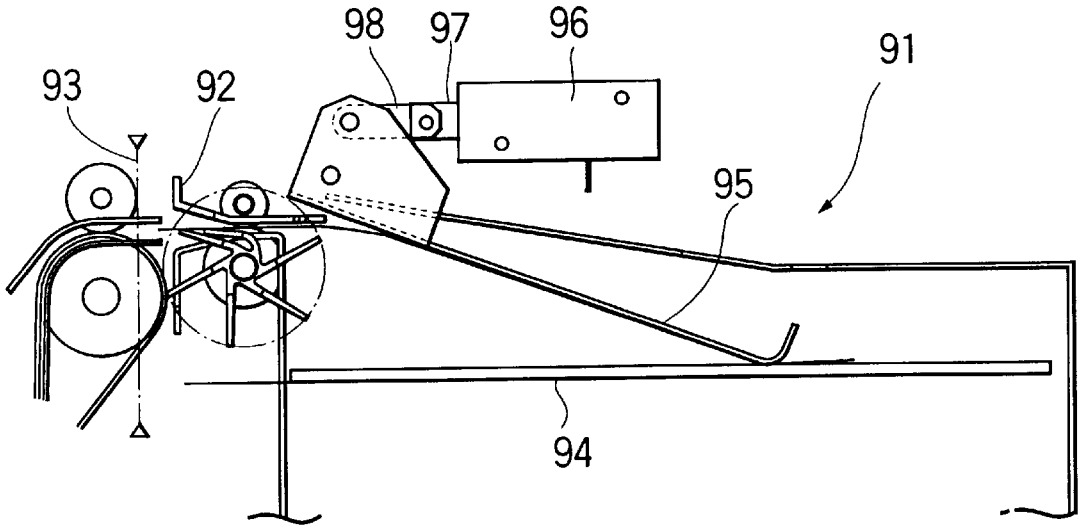
FIG. 11 is a schematic side view showing a bill stacking device of a safe in which a bill has been further fed into the safe and the rear end portion of the bill is detected by a sensor.
Figure 12:
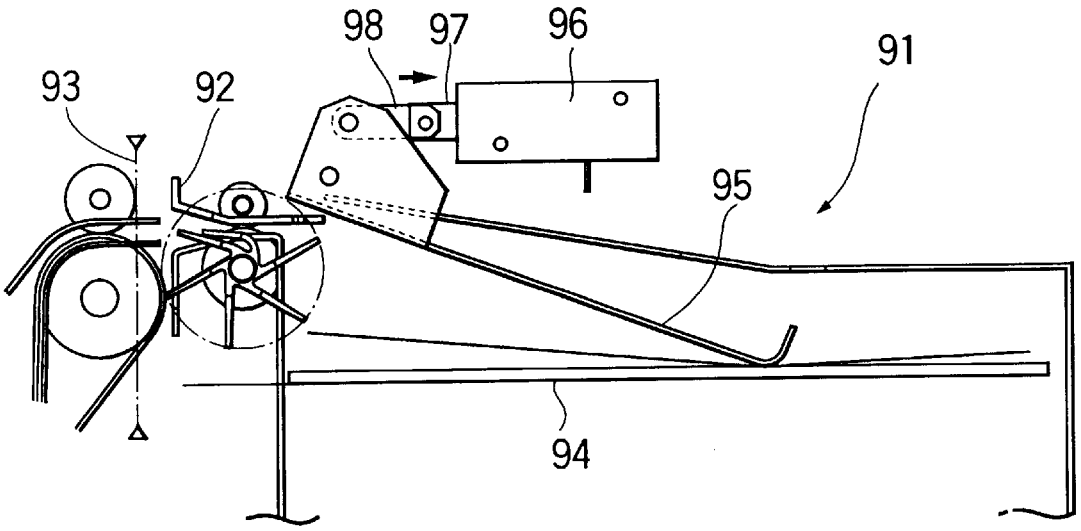
FIG. 12 is a schematic side view of a bill stacking device of a safe showing the leading end portion of a bill press plate pressed toward a bill stacking plate by driving a solenoid, thereby stopping a bill fed into the safe so that the rear end portion of the bill can be scraped off downwardly by a vane wheel.

On the contrary, after the motor shaft 54 has been rotated, the mounting unit 38 lowered and the bills stacked in the first bill stacking device held between the endless driven belts 34 and the endless drive belts 33, the roller 63 is moved downwardly along the opening 64 formed in the unit side plate 40 and, as shown in FIG. 8, the bill press plate 35 is located above the surface of the endless driven belts 34 on the side of the endless drive belts 33, thereby preventing the bill press plate 35 from influencing the feed-out operation of the bills from the first bill stacking device 30.

The first bill stacking device 30 is further provided with a bill stacking plate 70 on the upper surface of which bills are stacked when stacking bills. The bill stacking plate 70 is connected to a slide plate 71 engaged with the roller shaft 42 and is movable together with the mounting unit 38 and the endless driven belts 34. During bill stacking, therefore, the bill stacking plate 70 is located above the upper surface of the endless drive belts 33 through the space between the pair of endless drive belts 33 and bills are received on the upper surface thereof. On the other hand, when the stacked bills are held between the endless driven belts 34 and the endless drive belts 33 for feeding out the bills from the first bill stacking device 30, the bill stacking plate 70 is retracted below the upper surfaces of the endless driven belts 34. Since bills are stacked on the bill stacking plate 70 in this manner, the first bill stacked is not subjected to a frictional force from the endless drive belts 33. Therefore, it is ensured that the first bill can be stacked in the first bill stacking device 30 in the desired manner.

The second bill stacking device 80 has the same structure except that it is disposed adjacent to the second gate member 28 and behind the drum 4 in such a manner that the longitudinal direction thereof is substantially horizontal.

FIGS. 9 to 12 show the structure of the bill stacking device 91 of the safe 90 and the process for stacking bills in the safe 90.

As shown in FIGS. 9 to 12, the bill stacking device 91 of the safe 90 comprises a vane wheel 92 at its entrance and a sensor 93 for detecting the rear end portions of bills fed into the safe 90 by the vane wheel 92. Bills are stacked on a movable bill stacking plate 94. The movable bill stacking plate 94 is movable vertically in accordance with the number of bills stacked thereon and a bill press plate 95 is provided for pressing bills stacked on the movable stacking plate 94. The bill press plate 95 is fixed to the tip end portion of a link 98 connected to the plunger 97 of a solenoid 96.

FIGS. 9, 10, 11 and 12 respectively show the state when a bill has just been fed into the safe 90, when the leading end portion of the bill has been fed into the safe 90 and the bill is led along the lower surface of the bill press plate 95, when the bill has been further fed into the safe 90 and that the rear end portion of the bill is detected by the sensor 93 and when the solenoid 96 has been driven to press the leading end portion of the bill press plate 95 toward the bill stacking plate 94, thereby stopping the bill fed into the safe 90, and the rear end portion of the bill has been scraped off downwardly by the vane wheel 92. More specifically, when a predetermined time period has passed after a bill was fed into the safe 90 along the lower surface of the bill press plate 95 by the vane wheel 92 and the rear end portion of the bill was detected by the sensor 93, the solenoid 96 is driven, thereby stopping the bill fed into the safe 90 and the rear end portion of the bill is scraped off downwardly by the vane wheel. As a result, the bills are stacked on the bill stacking plate 94 in such a manner that the rear end portions thereof are aligned along the wall portion on the entrance side of the safe 90.

Figure 13:
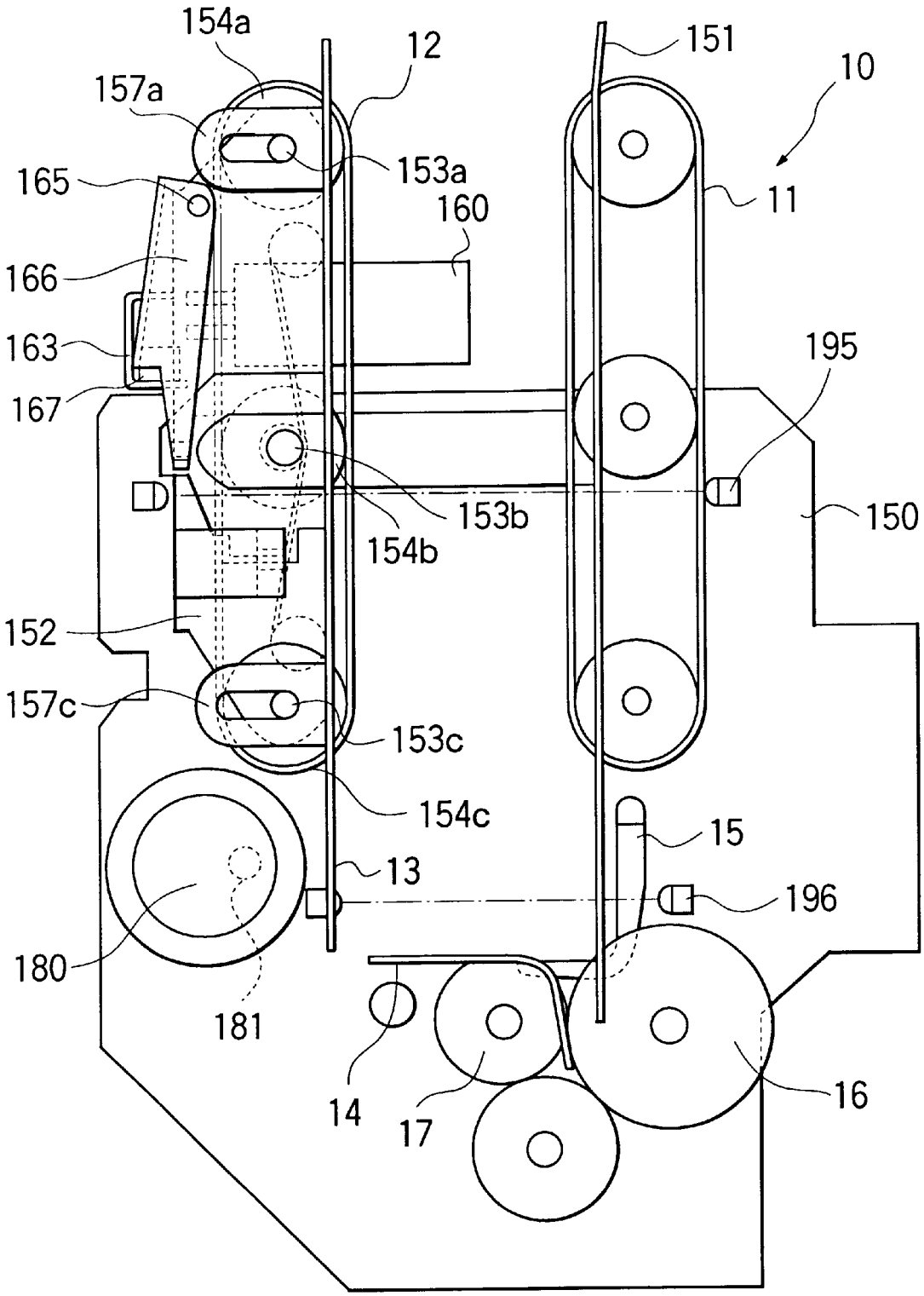
FIG. 13 is a schematic side view of a bill receiving section.
Figure 14:
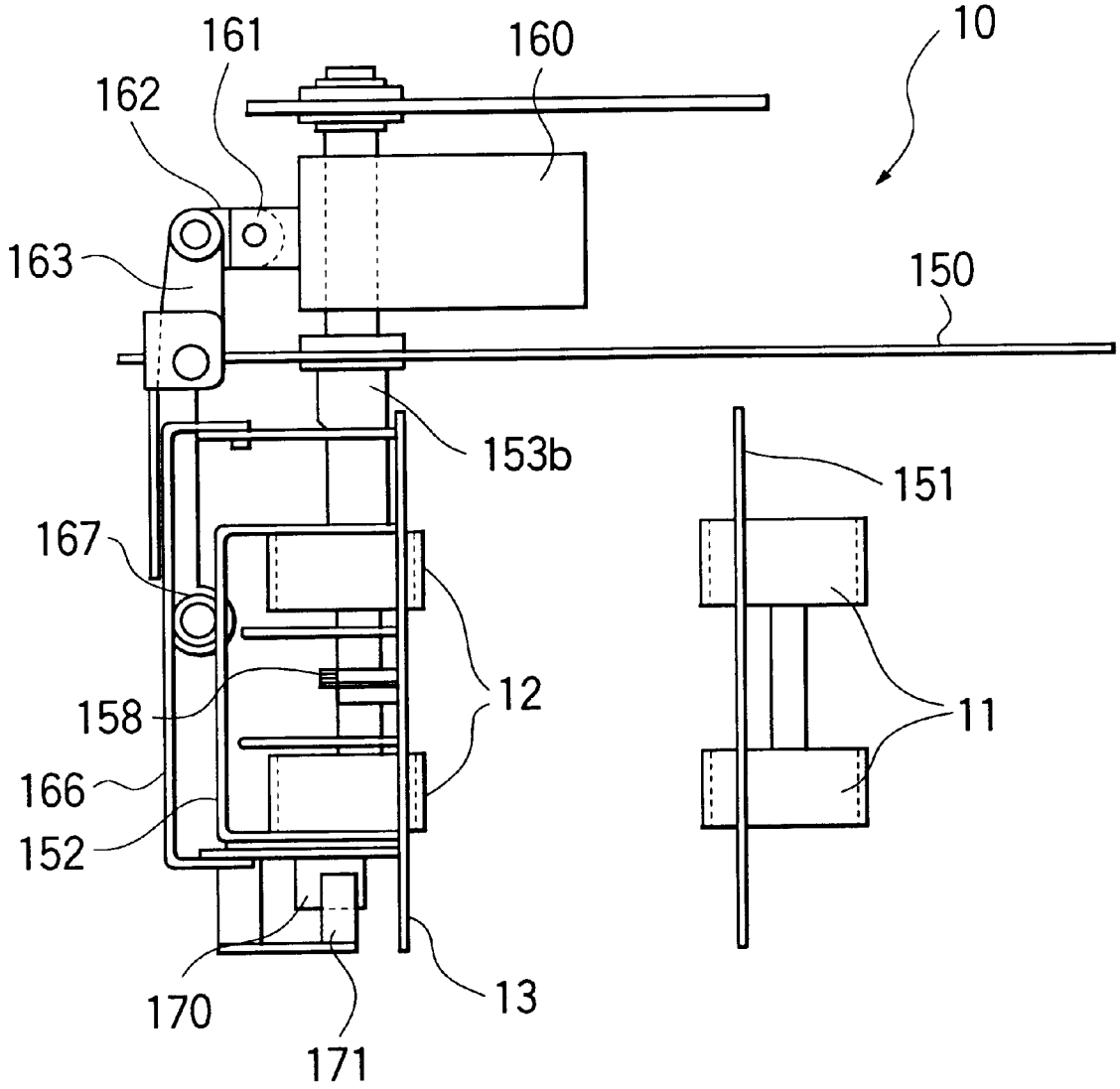
FIG. 14 is a schematic plan view of a bill receiving section.
Figure 15:
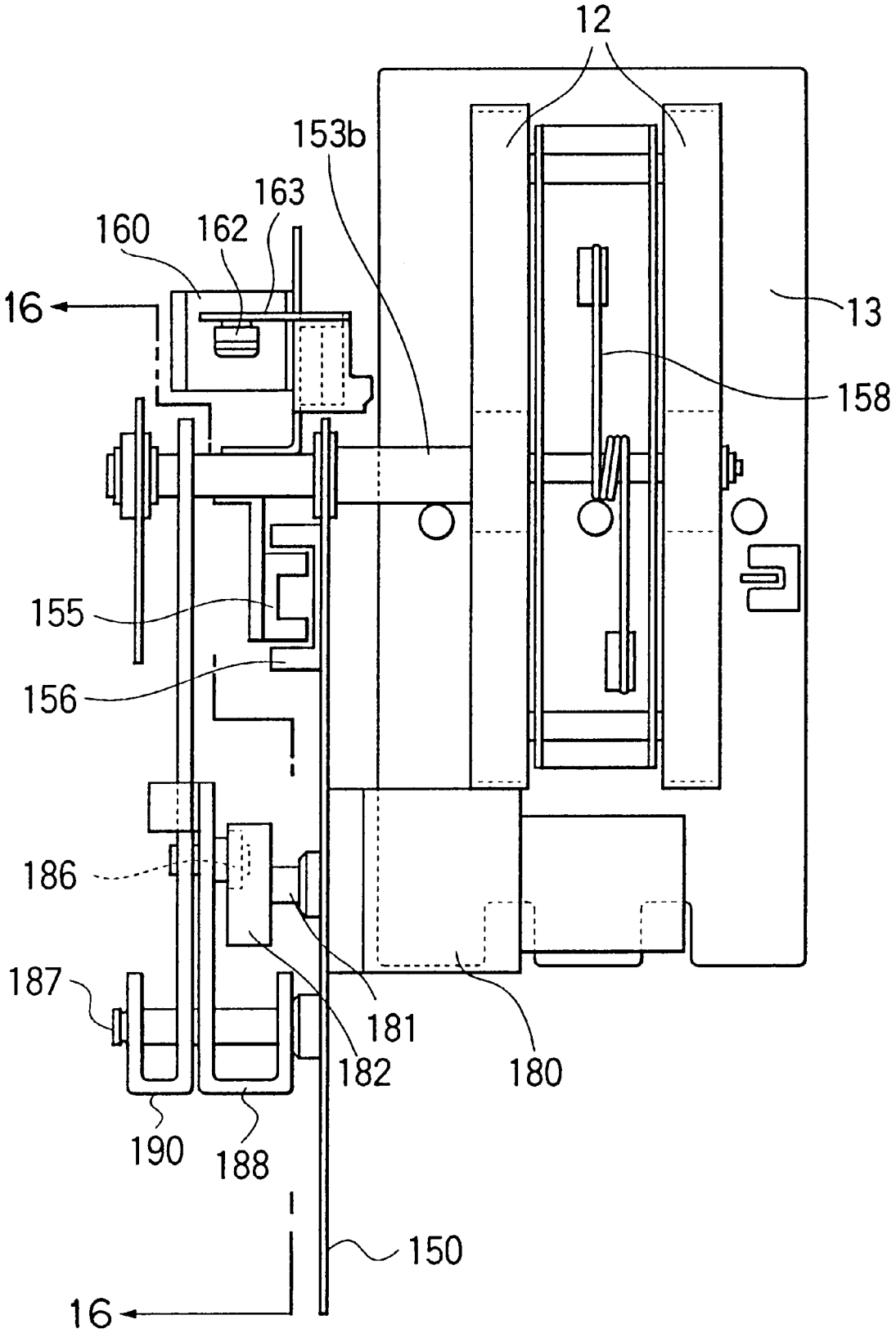
FIG. 15 is a schematic front view of a bill receiving section.

FIGS. 13, 14, 15 and 16 respectively show a schematic side view of the bill receiving section 10, a schematic plan view thereof, a schematic front 77 view thereof and a schematic cross sectional view taken along line A—A in FIG. 15.

As shown in FIGS. 13 to 15, the bill receiving section 10 comprises a unit side plate 150 and the pair of endless drive belts 11 are fixed to the unit side plate 150. A bill guide 151 is mounted on the unit side plate 150 to extend vertically. The movable endless driven belts 12 are wound around rollers 154*a*, 154*b*, 154*c* rotatably supported by shafts 153*a*, 153*b*, 153*c* supported by a support member 152. The center shaft 153*b* is fixed to the support member 152 and further projects to the outside of the unit side plate 150, as shown in FIGS. 14 and 15. A mounting block 155 is fixed to the projecting portion of the shaft 153*b*. The mounting block 155 is supported by the unit side plate 150 via a slide rail 156 that extends horizontally.

The bill press plate 13 is supported by the shaft 153*a*, 153*c* via supporting members 157*a*, 157*b* and is biased by a spring 158 toward the endless drive belts 11.

A solenoid 160 is supported by the shaft 153*b* projecting to the outside of the unit side plate 150 and an arm 163 is swingably supported by a link 162 mounted on the plunger 161 of the solenoid 160.

One end portion of a connecting member 166 is swingably mounted on a shaft 165 located in the vicinity of the upper end portion of the support member 152 and the other end portion of the connecting member 166 is engaged with the bill press plate 13. A roller 167 rotatably mounted on the arm 163 is engaged with the connecting member 166.

The bill press plate 13 is formed with a sensor actuating plate 170 and a sensor 171 actuated by the sensor actuating plate 170 is provided on the support member 152 for detecting the position of the bill press plate 13.

Figure 16:
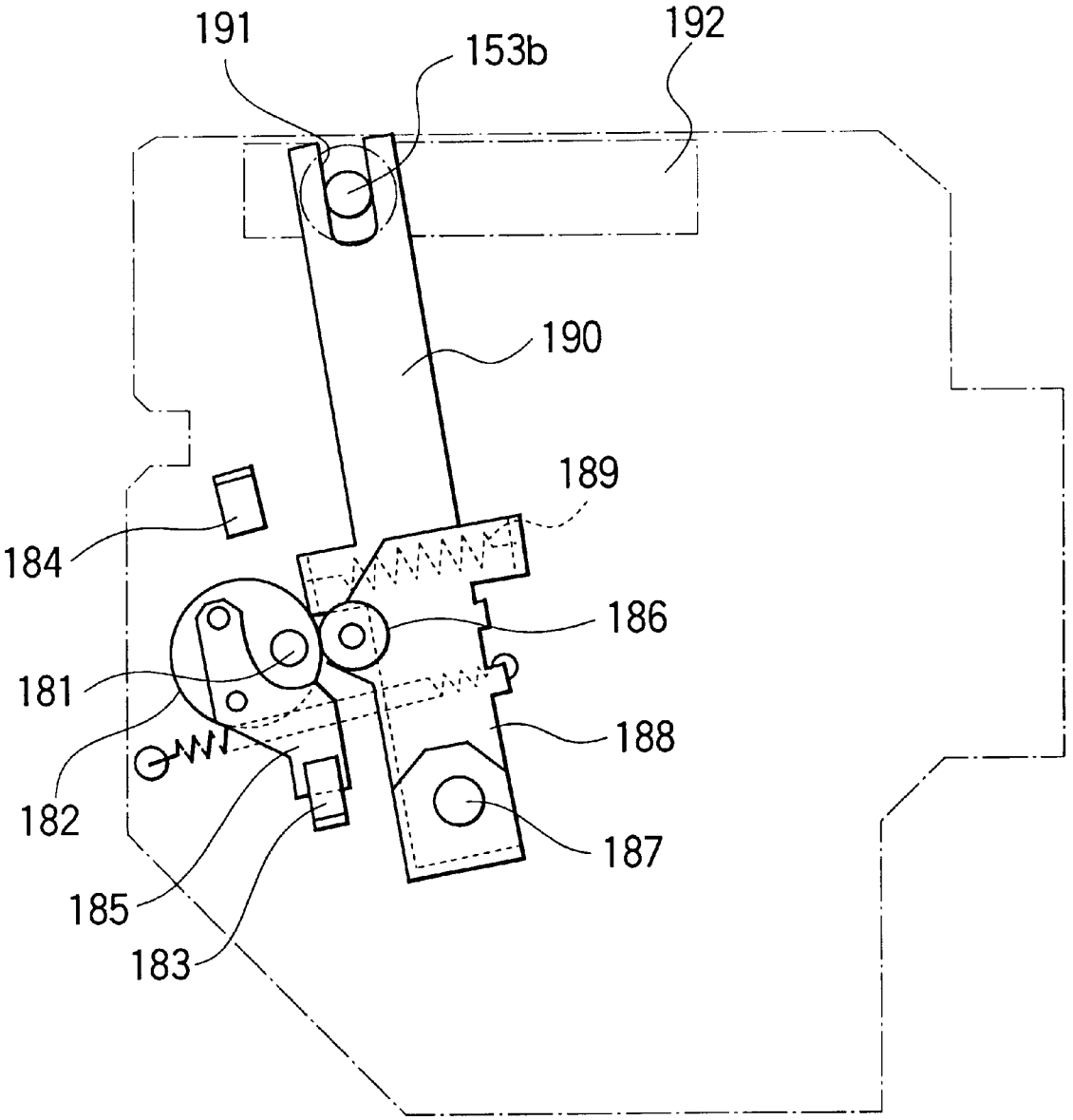
FIG. 16 is a schematic cross sectional view taken along line A—A in FIG. 15.

As shown in FIGS. 15 and 16, a cam 182 fixed to the output shaft 181 of a motor 180 is provided on the outside of the unit side plate 150 and a sensor 183 and a sensor 184 are provided in the vicinity of the cam 182. A sensor actuating plate 185 is mounted on the cam 182 for actuating the sensor 183 and the sensor 184.

A swing arm 190 which supports a cam follower 186 abutting against the cam 182 is provided in the vicinity of the cam 182. The swing arm 190 is swingably supported by a shaft 187 via a spring 189 and swingably supported by a shaft 187 at one end portion thereof and is connected to a drive arm 188. The other end portion of the swing arm 190 is formed with a notched portion 191 and the shaft 153*b* projecting from an opening 192 formed in the unit side plate 150 is engaged with the notched portion 191.

Further, as shown in FIG. 13, a sensor 195 is provided for discriminating whether or not a bill is present in the bill receiving section 10 and a sensor 196 is provided for detecting the rear end portions of bills taken out from the bill receiving section 10.

Figure 17:
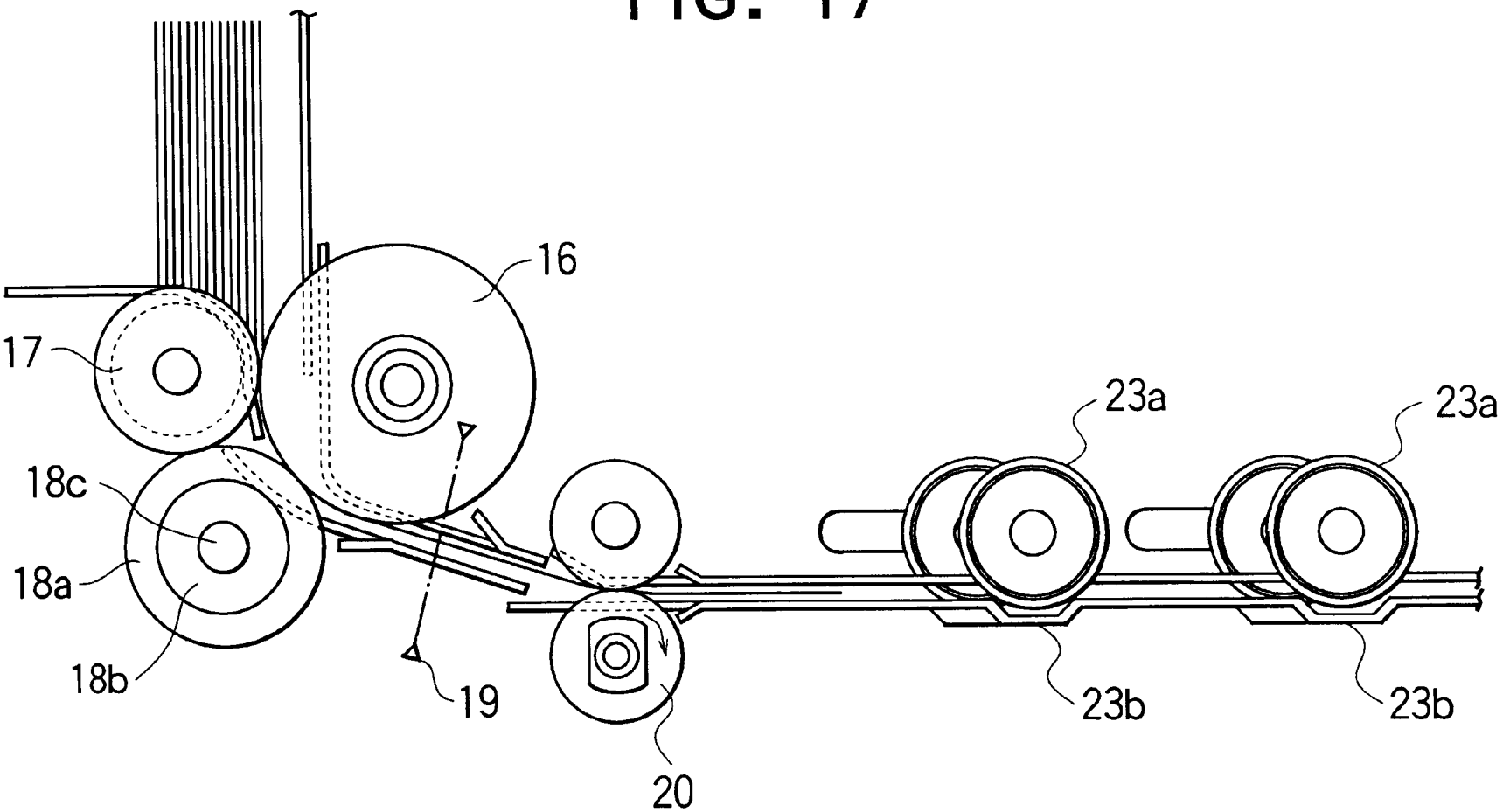
FIG. 17 is a schematic side view of a bill taking out device for taking out bills.

FIG. 17 is a schematic side view of a bill take-out device for taking out bills from the bill receiving section 10.

As shown in FIG. 17, the bill take-out device comprises the take-out roller 16 for making contact with the leading end portions of bills and taking out the bills, the separation roller 17 which cooperates with the take-out roller 16 to prevent two or more bills from being simultaneously taken out, a driven transporting roller 18*a* touching the circumference of the take-out roller 16, a sensor 19 for detecting bills and outputting a detection signal and a transporting roller 20.

The take-out roller 16 has a circumferential surface formed of a high friction material and is formed along the shaft thereof with a large diameter portion, a small diameter portion and a large diameter portion (not shown). The separation roller 17 is formed with a small diameter portion, a large diameter portion and a small diameter portion (not shown) that mesh with the large diameter portion, the small diameter portion and the large diameter portion of the take-out roller 16. Thus, a first bill separation section is formed by the takeout roller 16 and the separation roller 17 for preventing two or more bills from being simultaneously taken out.

The transporting roller 18*a* is connected to a support shaft 18*c* via a torque limiter 18*b* and a second bill separation section is formed by the take-out roller 16 and the transporting roller 18*a* for preventing two or more bills from being simultaneously taken out. The torque limiter 18*b* is constituted so as to disconnect the transporting roller 18*a* and the support shaft 18*c* when the torque acting on the transporting roller 18*a* is greater than or equal to a predetermined torque.

In FIG. 17, the reference numeral 23*a* designates transporting rollers provided in the first bill transporting section 23 for holding a bill between themselves and a bill guide 23*b* forming the lower surface of the first bill transporting section 23. The transporting rollers 23*a* are rotated faster than the take-out roller 16 to promote the separation of bills.

Figure 18:
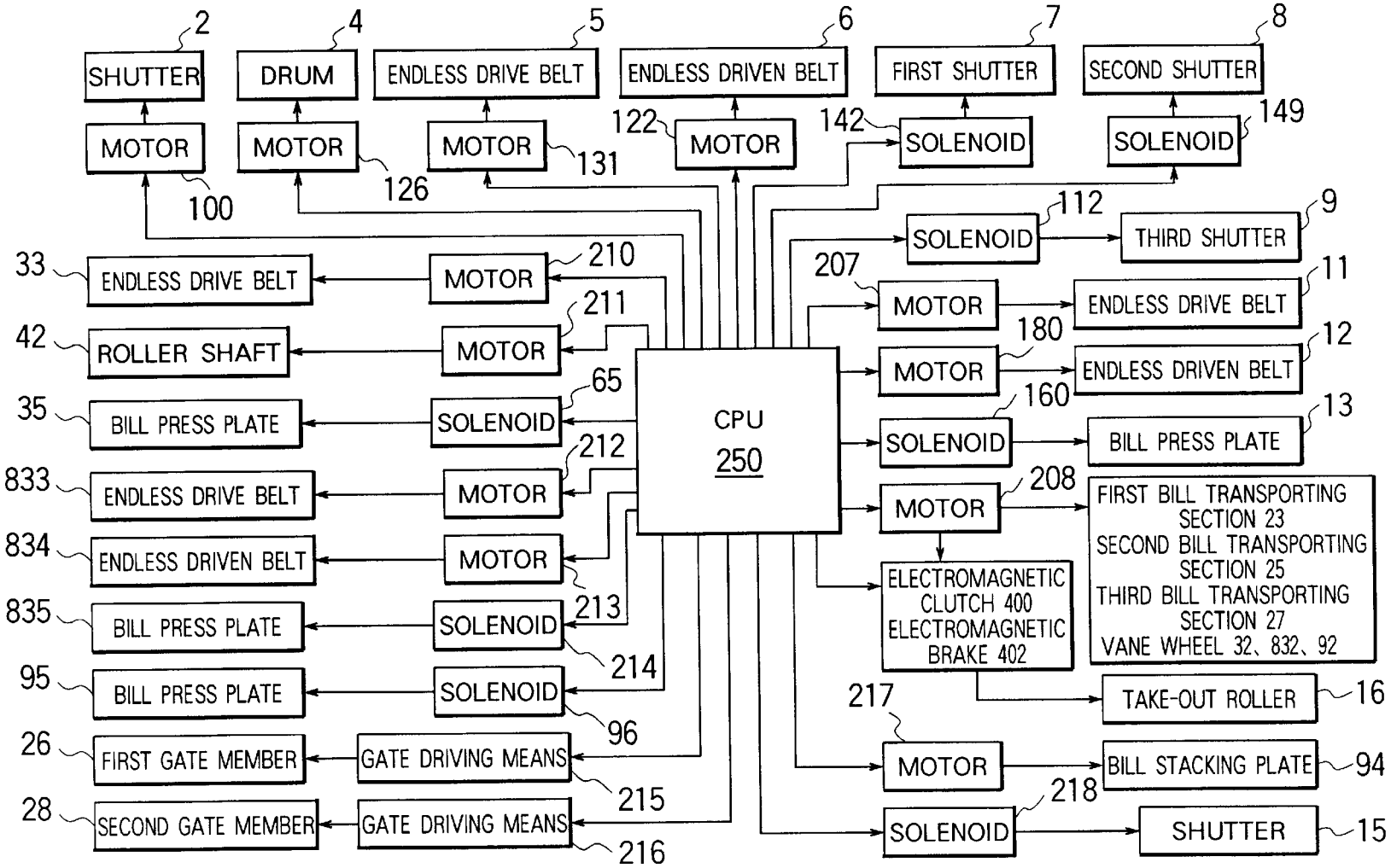
FIG. 18 is a block diagram of a drive system and a control system of a bill receiving machine which is an embodiment of the present invention.
Figure 19:
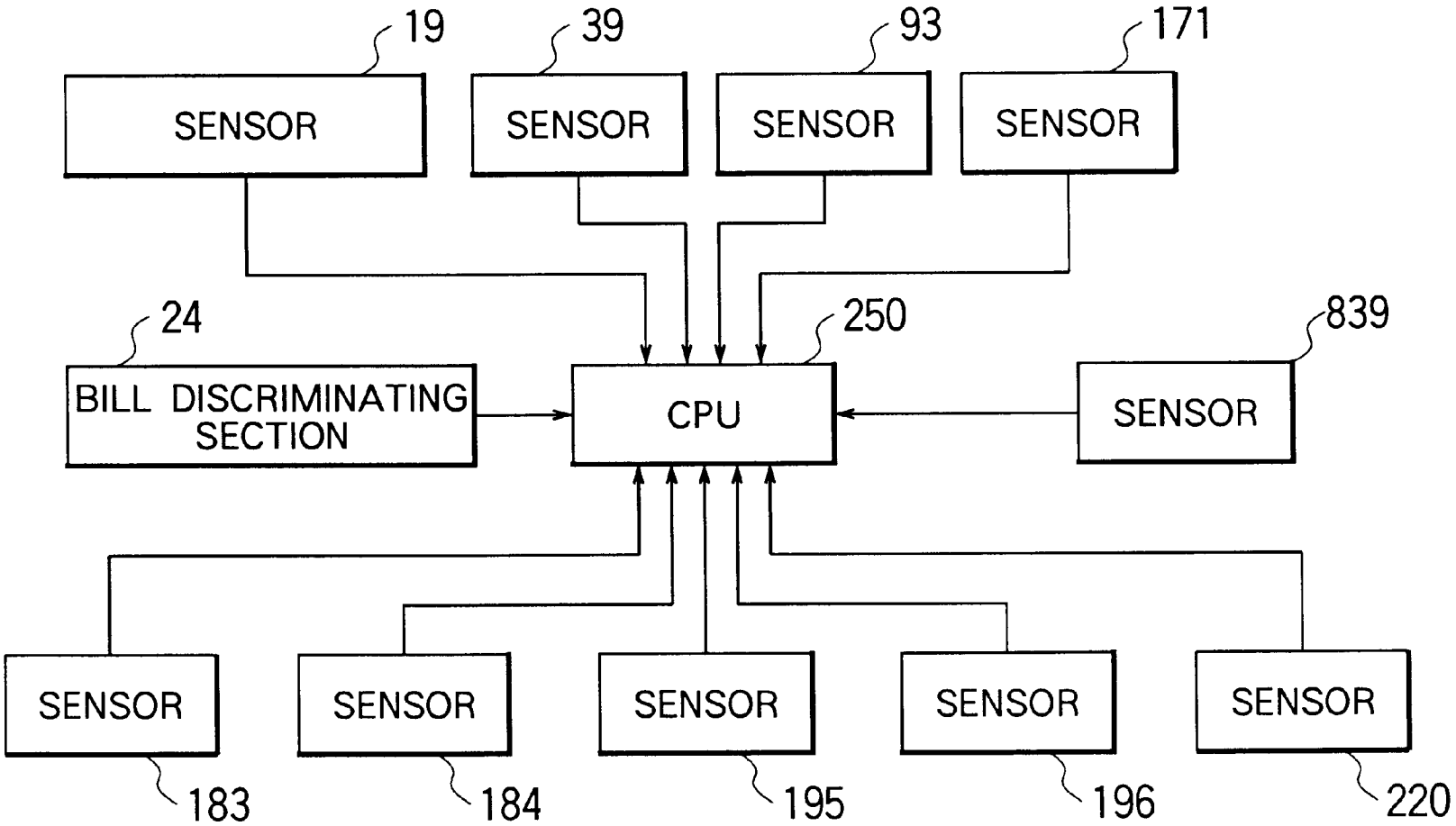
FIG. 19 is a block diagram of a detecting system and a control system of a bill receiving machine which is an embodiment of the present invention.

FIG. 18 is a block diagram of a drive system and a control system of a bill receiving machine which is an embodiment of the present invention and FIG. 19 is a block diagram of a detecting system and a control system thereof.

As shown in FIG. 18, the drive system of the bill receiving machine comprises a motor 100 for opening and closing the shutter 2, a motor 126 for rotating the drum 4, a motor 131 for driving the endless drive belts 5, a motor 122 for moving the endless driven belts 6, a solenoid 142 for opening and closing the first shutter 7, a solenoid 149 for opening and closing the second shutter 8, a solenoid 112 for projecting the third shutter 9 into the bill transport passage and retracting it therefrom, a motor 207 for driving the endless drive belts 11 in the bill receiving section 10, a motor 180 for moving the endless driven belts 12, a solenoid 160 for moving the bill press plate 13, a motor 208 for driving the first bill transporting section 23, the second bill transporting section 25 and the third bill transporting section 27, rotating the vane wheel 32 in the first bill stacking device 30, the vane wheel 832 in the bill stacking device 80 and the vane wheel 92 in the safe 90 and rotating the take-out roller 16 via an electromagnetic clutch 400 and an electromagnetic brake 402, a motor 210 for driving the endless drive belts 33 in the first bill stacking device 30, a motor 211 for rotating the motor shaft 54 in the first bill stacking device 30 and the endless driven belts 34, namely, the mounting unit 38, a solenoid 65 for moving the bill press plate 35 in the first bill stacking device 30, a motor 212 for driving the endless drive belts 833 fixed in the second bill stacking device 80, a motor 213 for moving the movable endless driven belts 834 provided in the second bill stacking device 80, a solenoid 214 for driving the bill press plate 835 provided in the second bill stacking device 80, a solenoid 96 for driving the bill press plate 95 in the safe 90, a gate driving means 215 for driving the first gate member 26, a gate driving means 216 for driving the second gate member 28, a motor 217 for moving the bill stacking plate 94 in the safe 90, and a solenoid 218 for opening and closing the shutter 15 in the bill receiving section 10.

As shown in FIG. 19, the detection system of the bill receiving machine comprises a sensor 19 provided in the vicinity of the take-out roller 16, a bill discriminating section 24 for discriminating whether or not a bill is acceptable and the denomination of the bill when the bill is acceptable, a sensor 39 provided at the entrance of the first bill stacking device 30, a sensor 839 provided at the entrance of the second bill stacking device 80, a sensor 93 provided at the entrance of the safe 90, a sensor 171 for detecting the position of the bill press plate 13, a sensor 183 and a sensor 184 for respectively detecting the position of the endless driven belts 12, a sensor 195 for detecting whether or not any bill is present in the bill receiving section 10, a sensor 196 for detecting the rear edge of a bill taken out from the bill receiving section 10, and a sensor 220 for detecting bills in the transaction opening 1. As shown in FIGS. 18 and 19, the control system of the bill receiving machine comprises a CPU 250 for outputting drive signals to the respective motors and solenoids constituting the drive system based on detection signals from the respective sensors constituting the detection system.

The thus constituted bill receiving machine which is an embodiment of the present invention handles bills deposited thereinto by a customer in the following manner.

When a customer inputs a predetermined instruction signal through an input means (not shown), the CPU 250 outputs drive signals to the motor 100, the solenoid 142 and the solenoid 112, thereby opening the shutter 2 and the first shutter 7 and projecting the third shutter 9 into the bill transport passage in the drum 4. Since the length between the end portion of the bill placement base 3 in the transaction opening 1 on the side opposite from the drum 4 and the central portion into which the third shutter 9 projects is determined to be slightly greater than the length of the longer edge of a bill whose longer edge is greatest among bills to be handled and the length between the end portion of the bill placement base 3 in the transaction opening 1 on the side opposite from the drum 4 and the end portion of the bill transport passage formed by the endless drive belts 5 and the endless driven belts 6 on the side of the transaction opening 1 is determined to be shorter than the length of the longer edge of a bill whose longer edge is shortest among bills to be handled, bills whose longer edges are greatest among bills to be handled are accommodated between the end portion of the bill placement base 3 on the side opposite from the drum 4 and the third shutter 9 to substantially abut against the third shutter 9 and bills whose longer edges are shortest are accommodated between the end portion of the bill placement base 3 on the side opposite from the drum 4 and the third shutter 9 in such a manner that a part thereof is placed on the endless drive belts 5.

Then, when the customer places bills on the bill placement base 3 in the transaction opening 1 and the endless drive belts 5 and inputs an instruction signal for receiving the bills through the input means, the CPU 250 outputs a drive signal to the solenoid 112, thereby retracting the third shutter 9 held at a position where it projects into the bill transporting passage and outputs a drive signal to the motor 122, thereby lowering the endless driven belts 6. Since bills whose longer edges are shortest are accommodated between the end portion of the bill placement base 3 opposite from the drum 4 and the third shutter 9 in such a manner that a part thereof is placed on the endless drive belts 5, all bills are held between the endless drive belts 5 and the endless driven belts 6. Further, the CPU 250 outputs a drive signal to the motor 131 to drive the endless drive belts 5, whereby the bills held between the endless drive belts and the endless driven belts 6 are taken in the drum 4.

When the bills have been taken in the drum 4, the CPU 250 outputs drive signals to the motor 100 and the solenoid 142, thereby closing the shutter 2 and the first shutter 7 and outputs a drive signal to the motor 126, thereby rotating the drum 4 counterclockwise by 90 degrees from the position shown in FIG. 1.

Then, the CPU 250 outputs a drive signal to the motor 180 and drives the motor 180 until the sensor 183 is actuated by the sensor actuating plate 185 and an actuating signal is input to the CPU 250, thereby moving the endless driven belts 12 away from the endless drive belts 11 as shown in FIGS. 13 and 14. Simultaneously, the CPU 250 outputs a drive signal to the solenoid 160 and drives the solenoid 160. As a result, the plunger 161 is retracted and the bill press plate 13 biased toward the endless drive belts 11 by the spring 158 via the link 162, the arm 163, the roller 167 at the tip end portion of the arm 163 and the connecting member 166 is retracted behind the surface of the endless driven belts 12 on the side of the endless drive belts 11 against the spring force of the spring 158.

Then, the CPU 250 outputs a drive signal to the solenoid 142, thereby opening the first shutter 7 and outputs a drive signal to the motor 131, thereby driving the endless drive belts 5, thereby feeding out the bills held between the endless drive belts 5 and the endless driven belts 6 from the drum 4. The CPU 250 outputs a stop signal to the motor 131 at the time a predetermined length of the bills has been fed out, thereby stopping the motor 131.

Further, the CPU 250 outputs a drive signal to the motor 180 and drives the motor 180 reversely until the sensor 184 is actuated by the sensor actuating plate 185 and an actuating signal is input to the CPU 250. Therefore, the cam follower 186 is pushed to the right in FIG. 16 by the cam 182, thereby swinging the drive arm 188 clockwise about the shaft 187 and the swing arm 190 connected to the drive arm 188 via the spring 189 is swung clockwise about the shaft 187. As a result, the shaft 153*b* engaged with the notched portion 191 formed in the tip end portion of the swing arm 190 is moved horizontally along the opening 192 of the unit side plate 150 and, therefore, the endless driven belts 12 is moved toward the endless drive belts 11. Although the drive arm 188 is swung clockwise about the shaft 187 by the motor 180 until the sensor 184 is actuated by the sensor actuating plate 185 and an actuating signal is input to the CPU 250, since the swinging movement of the swing arm 190 is prevented by the bills held between the endless drive belts 11 and the endless driven belts 12, the swing arm 190 is stopped at a position depending on the number of the bills. As a result, the endless driven belts 12 are biased by the spring force of the spring 189 toward the endless drive belts 11 and the bills are reliably held between the endless driven belts 12 and the endless drive belts 11.

Then, the CPU 250 outputs drive signals to the motor 131 and the motor 207 to drive the endless drive belts 5 and the endless drive belts 11, thereby feeding the bills held between the endless drive belts 5 and the endless driven belts 6 and between the endless drive belts 11 and the endless driven belts 12 into the bill receiving section 10.

When the bills are detected by the sensor 196 and a detection signal is input to the CPU 250, the CPU 250 outputs stop signals to the motor 131 and the motor 207, thereby stopping the endless drive belts 5 and the endless driven belts 6 and simultaneously outputs a stop signal to the solenoid 160 to stop the solenoid 160. As a result, the bill press plate 13 presses the bills by the spring force of the spring 158. Then, the CPU 250 outputs a drive signal to the motor 180 to drive the motor 180 in the forward direction. As the motor 180 is driven in the forward direction, the endless driven belts 12 begins to move apart from the endless drive belts 11 and the bill press plate 13 projects away from the endless driven belts 12 toward the endless drive belts 11 to hold the bills between the endless drive belts 11 and itself.

Figure 20:
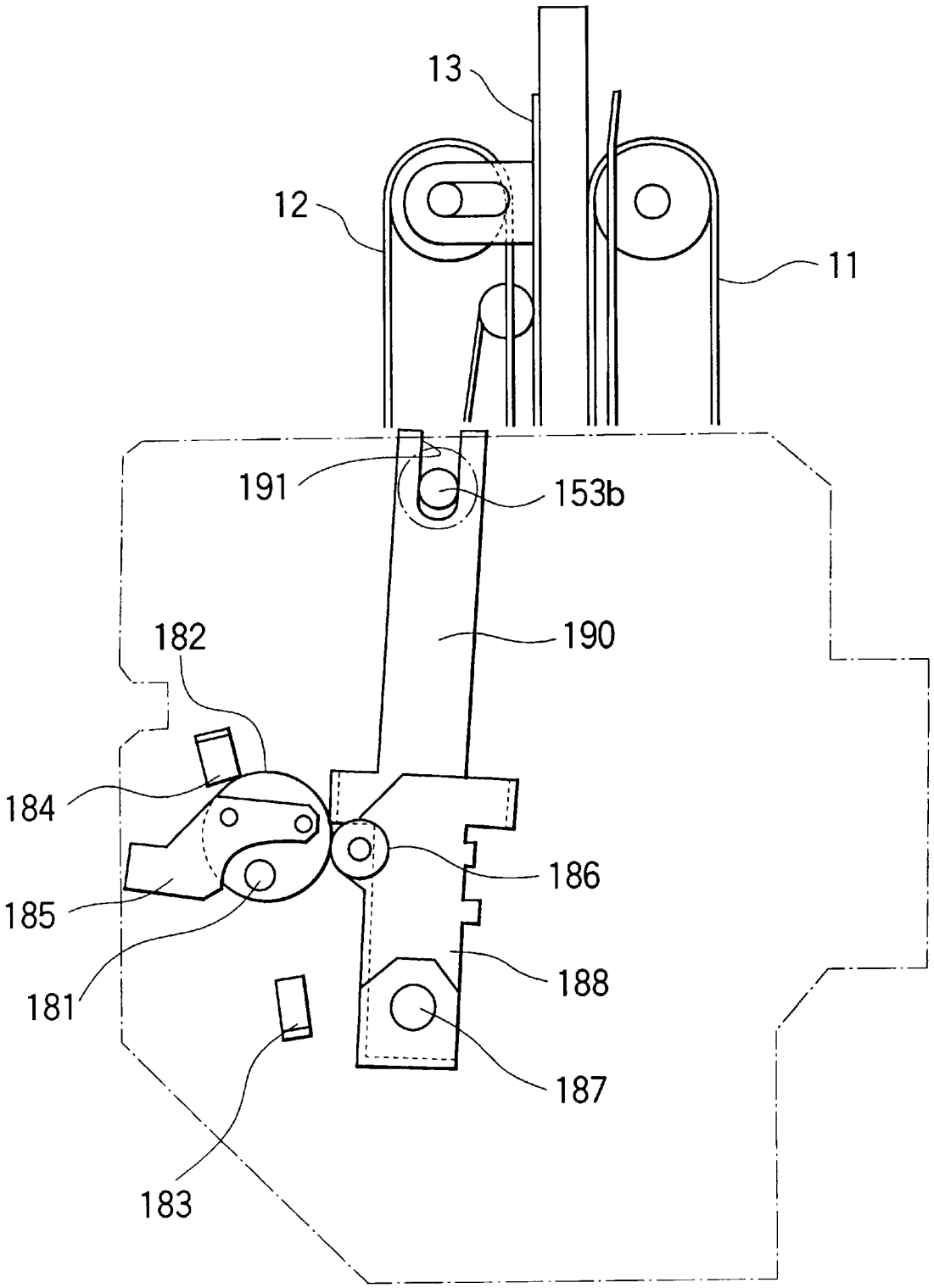
FIG. 20 is a schematic cross sectional view taken along line A—A in FIG. 15 with a motor stopped.

As the motor 180 is further rotated forwardly and the endless driven belts 12 are moved away from the endless drive belts 11, the bill press plate 13 is gradually moved away from the endless drive belts 11. As a result, when the sensor 171 is actuated by the sensor actuating plate 170 provided on the bill press plate 13, an actuation signal is input to the CPU 250 and the CPU 250 outputs a stop signal to the motor 180 to stop the drive of the motor 180. FIG. 20 shows the state when the motor 180 is stopped as a result of outputting the actuating signal from the sensor 171 to the CPU 250. In this state, the force acting on the bills from the bill press plate 13 and the endless drive belts 11 becomes substantially zero and, therefore, the bills fall onto the lower end plate 14 by their dead load. When the bills fall, the leading edges of the bills are substantially aligned with the upper surface of the lower end plate 14 due to a force acting on the bills from the lower end plate 14.

When a predetermined time period has passed after the CPU 250 outputted the stop signal to the motor 180, the CPU 250 outputs a drive signal to the motor 180 to drive the motor 180 reversely for a predetermined time period. As a result, the bills whose leading edges are located on the lower end plate 14 are again held between the bill press plate 13 and the endless drive belts 11. Then, the CPU 250 outputs a drive signal to the motor 180 to drive the motor 180 forwardly and when the sensor 171 is actuated by the sensor actuated plate 170 and an actuating signal is input to the CPU 250, the CPU 250 outputs a stop signal to the motor 180. Further, after a predetermined time period has passed, the CPU 250 outputs a drive signal to the motor 180 to drive the motor 180 reversely for a predetermined time period and outputs a stop signal to the motor 180 to stop the motor 180 while the bills are held between the bill press plate 13 and the endless drive belts 11.

In this manner, vibration is applied to the bills by repeating the holding operation of the bills between the bill press plate 13 and the endless drive belts 11 and the releasing operation of bills, whereby the leading edges of the bills are aligned with the upper surface of the lower end plate 14.

The received bills held by the bill press plate 13, the lower end plate 14 and the endless drive belts 11 are then taken out from the bill receiving section 10 one by one. For this, the CPU 250 outputs a drive signal to the motor 208, thereby driving the first bill transporting section 23, the second bill transporting section 25 and the third bill transporting section 27 and rotating the vane wheel 32 in the first bill stacking device 30, the vane wheel 832 in the second bill stacking device 80 and the vane wheel 92 in the safe 90. Then, the CPU 250 outputs a drive signal to the solenoid 218 to open the shutter 15 and outputs a drive signal to the motor 207 to drive the endless drive belts 11. As a result, a predetermined number of bills located on the side of the endless drive belts 11 are fed out toward the take-out roller 16.

Synchronously with the feeding out of the bills, the electromagnetic brake 402 is released and the electromagnetic clutch 400 is driven, whereby the take-out roller 16 is rotated and the bills are taken out one by one.

Since the circumferential surface of the take-out roller 16 is formed of a high friction material and the take-out roller 16 is formed with the large diameter portion, the small diameter portion and the large diameter portion (not shown) which mesh with the small diameter portion, the large diameter portion and the small diameter portion of the separation roller 17, a separation force acts on the bills from the first bill separation section constituted by the take-out roller 16 and the separation roller 17 to prevent two or more bills from being taken out simultaneously.

When two or more bills pass nevertheless through the first bill separation section, these bills are fed to the space between the take-out roller 16 and the transporting roller 18*a*. However, since the frictional force produced between adjacent bills is lower than the frictional force produced between the transporting roller 18*a* and a bill when one bill is held between the take-out roller 16 and the transporting roller 18*a*, the torque acting on the torque limiter 18*b* is less than the predetermined torque and, therefore, the transporting roller 18*a* and the support shaft 18*c* are connected by the torque limiter 18*b*. As a result, the transporting roller 18*a* is stopped by an inertial force and only the bill touching the rotating take-out roller 16 is transported downstream, whereby the bills are separated one by one and two or more bills are prevented from being simultaneously taken out.

Since the circumferential surface of the take-out roller 16 is formed of a high friction material, bills are normally separated one by one. However, two or more bills may be fed when parts thereof overlap. In this embodiment, therefore, when detection signals have been input from the sensor 19 for a time period longer than that required to detect a bill whose length is greatest among bills to be handled, the CPU 250 judges that two or more bills are being fed with considerable overlap. Since it is difficult to separate such bills one by one, the CPU 250 releases the electromagnetic clutch 400 for a predetermined time period and drives the electromagnetic brake 402 to temporarily stop the takeout roller 16. As a result, since the rear end portion of the preceding bill has already passed through the gap between the take-out roller 16 and the transporting roller 18*a*, only the preceding bill is fed downstream by the transporting rollers 23*a*, which are rotated at higher speed than the take-out roller 16, whereby the bills can be reliably separated one by one.

When the sensor no longer detects any bill taken out one by one from the bill receiving section 10, the CPU 250 further outputs a drive signal to the motor 207 to rotate the endless drive belts 11, thereby feeding out bills located on the side of the endless drive belts 11 toward the take-out roller 16.

In the first bill transporting section 23, each bill is fed toward the rear side on the bill receiving machine while its orientation is corrected so that the longer edge thereof lies parallel to the bill transporting direction, and is delivered to the second bill transporting section 25.

When a bill is delivered to the second bill transporting section 25, the bill discriminating section 24 provided at the beginning end portion of the second bill transporting section 25 discriminates whether or not it is acceptable and outputs a detection signal to the CPU 250.

The bill delivered to the second bill transporting section 25 is transported upwardly and then toward the rear side of the bill receiving machine. When a bill discriminated to be unacceptable by the bill discriminating section 24 reaches the first gate member 26 provided at the terminal end portion of the second bill transporting section 25, the CPU 250 outputs a drive signal to the first gate member 26 to drive the first gate member 26, thereby feeding the unacceptable bill into the first bill stacking device 30.

At this time, as shown in FIGS. 6 and 7, the mounting unit 38 is kept at an upper position, the endless driven belts 34 is positioned above the upper surface of the endless drive belts 33 and the bill press plate 35 is in abutment with the upper surface of the bill stacking plate 70. Therefore, the bill discriminated to be unacceptable by the bill discriminating section 24 is guided along the lower surface of the bill press plate 35 and fed into the first bill stacking device 30. when the sensor 39 provided at an entrance detects the rear end portion of the unacceptable bill, a detection signal is output to the CPU 250 and when a predetermined time period has passed after the CPU 250 received the detection signal from the sensor 39, the CPU 250 outputs a drive signal to the solenoid 65, thereby pressing the tip end portion of the bill press plate 35 toward the bill stacking plate 70. As a result, the unacceptable bill is stopped so that the leading end portion thereof is located at a predetermined position and the rear end portion of the unacceptable bill is scraped off by the vane wheel 32 rotated by the motor 208, whereby the unacceptable bill is stacked in the first bill stacking device 30 in such a manner that the rear end thereof is aligned with the wall portion of the first bill stacking device 30 on the side of the vane wheel 32.

On the other hand, when a bill discriminated to be acceptable by the bill discriminating section 24 has reached the first gate member 26, the CPU 250 outputs a reverse drive signal to the first gate member 26 to drive the first gate member reversely, thereby delivering the acceptable bill to the third bill transporting section 27 and transporting it upwardly. When the bill discriminated to be acceptable has reached the second gate member 28, the CPU 250 outputs a drive signal to the second gate member 28 to drive the second gate member 28, thereby feeding the acceptable bill into the second bill stacking device 80. The acceptable bill is guided along the lower surface of the bill press plate 835 and fed into the second bill stacking device 80. When the rear end portion of the acceptable bill is detected by the sensor 839 provided at the entrance of the second bill stacking device 80, a detection signal is output to the CPU 250 and when a predetermined time period has passed after the CPU 250 received the detection signal, the CPU 250 outputs a drive signal to the solenoid 214, thereby pressing the bill press plate 835 downwardly. As a result, the acceptable bill is stopped so that the leading end portion thereof is located at a predetermined position and the rear end portion of the acceptable bill is scraped off by the vane wheel 832 rotated by the motor 208, whereby the acceptable bill is stacked in the second bill stacking device 80 in such a manner that the rear end thereof is aligned with the wall portion of the first bill stacking device 80 on the side of the vane wheel 832.

When the CPU 250 judges based on a detection signal from the sensor 195 and the sensor 196 and a detection signal input from the bill discriminating section 24 that the last bill fed out from the bill receiving section 10 has been transported into the first bill stacking device 30, the second bill stacking device 80 or the safe 90, the CPU 250 outputs a drive signal to the motor 211 and rotates the motor shaft 54 to move the mounting unit 38 and the endless driven belts 34 downwardly. As a result, unacceptable bills stacked in the first bill stacking device 30 are held between the endless driven belts 34 and the endless drive belts 33. At this time, the bill press plate 35 is located above the upper surface of the endless drive belts 33. Simultaneously, the CPU 250 outputs a drive signal to the motor 126, thereby rotating the drum 4 clockwise by about 45 degrees from the position shown in FIG. 1 and outputs a drive signal to the solenoid 149 to open the second shutter 8, whereby the leading end portions of the unacceptable bills held by the endless driven belts 34 and the endless drive belts 33 are held by the endless drive belts 5 and the endless driven belts 6. Then, the CPU 250 outputs drive signals to the motor 210 and the motor 131 to drive the endless drive belts 33 and the endless drive belts 5, thereby taking the unacceptable bills in the drum 4.

When the unacceptable bills have been taken in the drum 4, the CPU 250 outputs a drive signal to the solenoid 149 to close the second shutter 8 and outputs a drive signal to the motor 126, thereby rotating the drum 4 counterclockwise by about 45 degrees. Further, the CPU 250 outputs drive signals to the solenoid 142 and the motor 100 to open the first shutter 7 and the shutter 2 of the transaction opening 1 and outputs a drive signal to the motor 131 to drive the endless drive belts 5, thereby returning the unacceptable bills onto the bill placement base 3 in the transaction opening 1. Then, the CPU 250 outputs a drive signal to the solenoid 112 to project the third shutter 9 into the bill transport passage, thereby closing the bill transport passage in the drum 4 and outputs a drive signal to the motor 122 to retract the endless driven belts 6 to its retracted position. In this embodiment, since the length between the end portion of the bill placement base 3 in the transaction opening 1 on the side opposite from the drum 4 and the portion into which the third shutter 9 projects is determined to be slightly greater than the length of the longer edge of a bill whose longer edge is greatest among bills to be handled and the length between the end portion of the bill placement base 3 on the side of the drum 4 and the portion into which the third shutter 9 projects is determined to be shorter than the length of the longer edge of a bill whose longer edge is shortest among bills to be handled, the bills whose longer edges are greatest among the bills to be handled are placed over the entire portion of the bill placement base 3 and parts of the bills whose longer edges are shortest are placed on the bill placement base 3 and both of them are returned to the transaction opening 1. Further, the CPU 250 outputs a drive signal to the motor 100, thereby locating the shutter 2 on the bills returned onto the bill placement base 3 in the transaction opening 1 to press the bills by the dead load of the shutter 2.

On the other hand, after all deposited bills have been fed out from the bill receiving section 10 and the bill discriminating section 24 has discriminated whether or not the bills are acceptable and the denominations of the acceptable bills, the CPU 250 displays the results of the discrimination on the display means (not shown). When the customer confirms the value of deposited bills and instructs the input means (not shown) to receive the bills, the bills which were discriminated to be acceptable and were stacked in the second bill stacking device 80 are fed back into the drum 4 located at a position shown in FIG. 1 in accordance with a signal from the CPU 250 in the same manner as that of the unacceptable bills.

The acceptable bills fed back into the drum 4 are fed into the bill receiving section 10 in the same manner as when first deposited and are further fed to the second gate member 28 via the first bill transporting section 23, the second bill transporting section 25, the first gate member 26 and the third bill transporting section 27. Then, they are fed toward to the safe 90 by the second gate member 28.

As shown in FIGS. 9 to 12, each of the acceptable bills fed toward the safe 90 is guided along the lower surface of the bill press plate 95 and fed into the safe 90. When a predetermined time period has passed after the sensor 93 detected the rear end portion of an acceptable bill and a detection signal was output to the CPU 250, the CPU 250 outputs a drive signal to the solenoid 96 to drive the solenoid 96, whereby the acceptable bill is stopped so that the leading edge thereof is located at a predetermined position and the rear end portion thereof is scraped off by the vane wheel 92 rotated by the motor 208 so that the acceptable bill is stacked in the safe 90 in such a manner that the rear end portion thereof is aligned with the wall portion of the safe 90 on the side of the vane wheel 92.

When the customer does not accept the unacceptable bills returned to the transaction opening 1, even after a predetermined time period has passed from the return of the unacceptable bills the transaction opening 1, the shutter 2 of the transaction opening 1 and the first shutter 7 are opened and the unacceptable bills on the bill placement base 3 are taken in the drum 4 in the same manner as when depositing bills. Then, the drum 4 is rotated counterclockwise to a position where it faces the entrance of the unacceptable bill collecting section 29 and the endless drive belts 5 is driven, whereby the unacceptable bills are collected in the unacceptable bill collecting section 29.

According to the above described embodiment, bills are held between the endless drive belts 11 and the endless driven belts 12, while they are held between the endless drive belts 5 and the endless driven belts 6 and are delivered to the bill receiving section 10. The bills can therefore be transported so that their longer edges lie parallel to the bill transporting direction and even bills whose lengths in the bill transporting direction are much different can be fed into the bill receiving section 10 without disturbing the positional relationship therebetween. Further, after the bills were transported to a predetermined position by the endless drive belts 11 and the endless driven belts 12, the bill press plate 13 is projected and the bills are held between the bill press plate 13 and the endless drive belts 11. Then, the endless driven belts 12 are moved to a predetermined position apart from the endless driven belts 11, thereby releasing the bills held by the bill press plate 13 and the endless drive belts 11 and dropping the bills on the lower end plate 14. Therefore, the bills can be transported so that their longer edges lie parallel to the bill transporting direction and even in the case of bills whose lengths in the bill transporting direction differ greatly, the leading edges thereof can be reliably aligned with the upper surface of the lower end plate 14 and the bills can be separated one by one and handled.

Moreover, according to the above described embodiment, the bills dropped on the lower end plate 14 are held between the bill press plate 13 and the endless drive belts 11, released and again held between the bill press plate 13 and the endless drive belts 11, whereafter the bills are fed out from the bill receiving section 10. Therefore, since vibration is applied to the bills, it is possible to more reliably align the leading edges of the bills with the upper surface of the lower end plate 14 and separate the bills one by one.

Further, according to the above described embodiment, since bills are fed out by the endless drive belts 11 from the bill receiving section 10 toward the take-out roller 16, it is possible to take out the bills from the bill receiving section 10 without the feed roller which is normally provided and, therefore, the structure of the bill receiving section can be simplified.

Furthermore, the first bill stacking device 30 for stacking unacceptable bills therein, the second stacking device 80 for stacking acceptable bills therein and the bill stacking device 91 of the safe 90 for stacking received bills therein are respectively provided with the bill press plates 35, 835, 95 which guide each bill along the lower surface thereof into the bill stacking devices and press onto the bill when a predetermined time period has passed after the rear end portion of the bill was detected, thereby stopping the bill so that the leading edge of the bill is located at a predetermined position. Therefore, even if bills whose lengths in the bill transporting direction differ greatly are transported in such a manner that their longer edges are oriented in the bill transporting direction, it is possible to stack the bills so that one end portions thereof are aligned.

Moreover, the length between the end portion of the bill placement base 3 in the transaction opening 1 on the side opposite from the drum 4 and the portion into which the third shutter 9 projects is determined to be slightly greater than the length of the longer edge of a bill whose longer edge is greatest among bills to be handled and the length between the end portion of the bill placement base 3 in the transaction opening 1 on the side opposite from the drum 4 and the end portion of the bill transport passage formed by the endless drive belts 5 and the endless driven belts 6 on the side of the transaction opening 1 is determined to be shorter than the length of the longer edge of a bill whose longer edge is shortest among bills to be handled. Therefore, bills can be deposited into the transaction opening 1 so that bills whose longer edges are greatest among bills to be handled are accommodated between the end portion of the bill placement base 3 opposite from the drum 4 and the third shutter 9 to substantially abut against the third shutter 9 and that bills whose longer edges are shortest are accommodated between the end portion of the bill placement base 3 opposite from the drum 4 and the third shutter 9 in such a manner that parts thereof are placed on the endless drive belts 5, whereby the bills deposited into the transaction opening 1 can be reliably taken into the bill receiving machine irrespective of their lengths. Further, the length between the end portion of the bill placement base 3 on the side of the drum 4 and the portion of the bill transport passage into which the third shutter 9 projects is determined to be shorter than the length of the longer edge of a bill whose longer edge is shortest among bills to be handled. When unacceptable bill are returned, therefore, bills whose longer edges are shortest among bills to be handled can be returned in such a manner that parts thereof are placed on the bill placement base 3 so that the customer can easily collect unacceptable bills.

The present invention has thus been shown and described with reference to specific embodiments. However, it should be noted that the present invention is in no way limited to the details of the described arrangements but changes and modifications may be made without departing from the scope of the appended claims.

For example, in the above described embodiment, although the explanation is made with respect to the case where a bill handling machine is a bill receiving machine, the present invention is applicable to bill handling machines other than the bill receiving machine such as a bill receiving and dispensing machine and a bill counting machine.

Further, in the above described embodiment, although the first bill stacking device 30 for stacking unacceptable bills therein, the second stacking device 80 for stacking acceptable bills therein and the bill stacking device 91 of the safe 90 for stacking received bills therein are respectively provided with the vane wheels 32, 832, 92, the vane wheels 32, 832, 92 are not absolutely necessary, since the bill press plates 35, 835, 95 are provided for stopping bills so that the leading edges thereof are located at a predetermined position and the bills can therefore be stacked with their rear end portions are aligned without using the vane wheels 32, 832, 92.

Furthermore, in the above described embodiment, although the bill press plates 35, 835, 95 are driven by the solenoids 65, 214, 96, the bill press plates 35, 835, 95 may be driven by other drive means than the solenoids 65, 214, 96.

Moreover, in the above described embodiment, bills dropped on the lower end plate 14 are held between the bill press plate 13 and the endless drive belts 11, released and again held between the bill press plate 13 and the endless drive belts 11, whereafter the bills are fed out of the bill receiving section 10. However. bills dropped on the lower end plate 14 and held between the bill press plate 13 and the endless drive belts 11 can be fed out without releasing them or be fed out after the holding and releasing of the bills has been repeated several times.

Further, in the above described embodiment, although the take-out roller 16 is temporarily stopped when bill detection signals have been input from the sensor 19 to the CPU 250 for a time period longer than a predetermined time period required to detect a bill whose length is greatest among bills to be handled, the predetermined time period is not limited to the time period required to detect a bill whose length is greatest among bills to be handled and may be arbitrarily determined depending on the maximum length and the minimum length of bills to be handled, the rotation speed of the take-out roller 16, the rotation speed of the transporting rollers 23*a*, material of the bills to be handled and the like.

According to the present invention, it is possible to provide a bill handling machine which can reliably and efficiently separate and handle bills whose lengths in the bill transporting direction differ greatly.

We claim:

1. A bill handling machine comprising take-out roller means having an entire circumferential surface being formed with a high friction material and which is positioned to engage leading edge portions of stacked bills so as to take out the bills, separation roller means for cooperating with the take-out roller means and preventing two or more bills from being simultaneously taken out, bill detecting means provided downstream of the take-out roller means and the separation roller means for detecting whether any bill is present and producing detection signals in response thereto, transporting roller means provided downstream of the bill detecting means and rotated at higher speed than the take-out roller means, and control means for judging that two or more bills are partly overlapped when detection signals have been produced from the bill detecting means for a time period longer than a predetermined time period and then stopping the take-out roller means in response thereto, said transporting roller means being disposed so as to be able to transport a preceding bill among the bills partly overlapped.

2. A bill handling machine in accordance with claim 1 wherein the predetermined time period is equal to a time period required to detect bills whose length is maximum along bills to be handled.

* * * * *

UNITED STATES PATENT AND TRADEMARK OFFICE

CERTIFICATE OF CORRECTION

PATENT NO. : 5,996,993
DATED : December 7, 1999
INVENTOR(S) : Junichi ARIKAWA et al.

It is certified that error appears in the above-indentified patent and that said Letters Patent is hereby corrected as shown below:

Item [56] References Cited under, "U.S. PATENT DOCUMENTS", insert --4,570,801 2/1986 Brannen 4,651,982 3/1987 Martin 4,737,627 4/1988 Hughes 4,880,096 11/1989 Kobayashi et al.

4,922,110 5/1990 Melcher--, under "FOREIGN PATENT DOCUMENTS", insert

-- 50-48667 4/1975 Japan --.

Signed and Sealed this

Tenth Day of April, 2001

*Attest:*

Nicholas P. Godici

NICHOLAS P. GODICI

*Attesting Officer*

*Acting Director of the United States Patent and Trademark Office*